US012759769B2

(12) United States Patent
Gao et al.

(10) Patent No.: US 12,759,769 B2
(45) Date of Patent: Oct. 13, 2026

(54) EASY CLEAN INSULATED CUP WITH A FLIP STRAW AND LID CLOSURE

(71) Applicant: Munchkin Incorporated, Van Nuys, CA (US)

(72) Inventors: Fangyi Gao, Pasadena, CA (US); Agnes Yena Lee, Los Angeles, CA (US); Yifan Ding, Somerville, MA (US)

(73) Assignee: MUNCHKIN, INC., Van Nuys, CA (US)

( * ) Notice: Subject to any disclaimer, the term of this patent is extended or adjusted under 35 U.S.C. 154(b) by 0 days.

(21) Appl. No.: 19/078,158

(22) Filed: Mar. 12, 2025

(65) Prior Publication Data

US 2025/0289629 A1 Sep. 18, 2025

Related U.S. Application Data

(60) Provisional application No. 63/763,198, filed on Feb. 25, 2025, provisional application No. 63/564,444, filed on Mar. 12, 2024.

(51) Int. Cl.

| | |
|---|---|
| ***B65D 47/08*** | (2006.01) |
| ***A47G 19/22*** | (2006.01) |
| ***B65D 23/10*** | (2006.01) |

(52) U.S. Cl.

CPC ..... *B65D 47/088* (2013.01); *A47G 19/2272* (2013.01); *B65D 23/104* (2013.01)

(58) Field of Classification Search

CPC .... B65D 47/088; B65D 23/104; B65D 77/28; B65D 81/3841; B65D 2525/282; B65D 2525/285; B65D 25/2808; B65D 25/2811; B65D 47/066; B65D 47/0857; B65D 47/2031; A47G 19/2272; A47G 19/2266

See application file for complete search history.

(56) References Cited

U.S. PATENT DOCUMENTS

| | | | | |
|---|---|---|---|---|
| 4,408,702 | A * | 10/1983 | Horvath | B05B 11/048 222/496 |
| 5,150,815 | A * | 9/1992 | Saklad | B65D 77/283 215/229 |
| 5,361,934 | A * | 11/1994 | Spence, Jr. | B65D 47/2043 220/709 |
| 6,196,413 | B1 * | 3/2001 | Tung | B65D 77/283 220/717 |
| 6,523,711 | B1 * | 2/2003 | Hughes | B05B 11/1097 239/33 |
| 11,542,074 | B1 * | 1/2023 | Lee | B65D 47/0885 |
| 2009/0139952 | A1 * | 6/2009 | Raman | B65D 77/283 215/229 |

* cited by examiner

*Primary Examiner* — Kareen K Thomas

(74) *Attorney, Agent, or Firm* — Robert Evora; ArentFox Schiff LLP

(57) ABSTRACT

A removable valve and lid assembly can include a removable valve and a lid. The removable valve can have a pressure valve and a spout. The lid can have a closing structure operable to control access to an opening of the lid and a securing mechanism disposed adjacent to the opening, wherein the securing mechanism is configured to receive and secure the removable valve, and wherein the closing structure includes a protrusion configured to press against the spout of the removable valve when the removable valve is disposed within the opening of the lid and when the closing structure is pressed against the spout. The removable valve and lid assembly can be used to seal a container or bottle.

10 Claims, 23 Drawing Sheets

EASY CLEAN INSULATED CUP WITH A FLIP STRAW AND LID CLOSURE

CROSS-REFERENCE TO RELATED APPLICATIONS

This patent applications claimed the benefit of and priority to U.S. Provisional Patent Application No. 63/564,444, filed on Mar. 12, 2024, entitled "MULTI-MODE BOTTLES," and U.S. Provisional Patent Application No. 63/763,198, filed on Feb. 25, 2025, entitled "EASY CLEAN INSULATED CUP WITH A FLIP STRAW AND LID CLOSURE," both of which are expressly incorporated by reference herein in their entirety.

TECHNICAL FIELD

The subject disclosure relates generally to bottles. More particularly, the present disclosure relates to multi-mode bottles.

BACKGROUND

There are numerous types of bottles on the market adapted for use by adults and children. These bottles are often formed of a durable material and may include features that make it easier for adults and children to drink from the bottle, such as attached drinking straws, sealed lids with spouts, and the like. Many types of bottles have lids that include features to prevent or guard against spills and accidental leaks. Additionally, constantly multi-tasking and transporting reusable bottles creates a need for drinking solutions that are portable, easy to secure and easy to use. Some bottles with lids come with a straw mechanism and others accommodate straws. Other bottles are designed to have a screw off top that allows the contents to be poured into another container, such as a cup.

Thus, there is a need for a universal bottle assembly which is portable, easy to use, easy to clean and has a built-in design that promotes use for various fluids in various modes.

SUMMARY

The present subject disclosure presents a simplified summary of the subject disclosure in order to provide a basic understanding of some aspects thereof. This summary is not an extensive overview of the various embodiments of the subject disclosure. It is intended to neither identify key or critical elements of the subject disclosure nor delineate any scope thereof. The sole purpose of the subject summary is to present some concepts in a simplified form as a prelude to the more detailed description that is presented hereinafter.

While various aspects, features, or advantages of the subject disclosure are illustrated in reference to bottle assemblies, such aspects and features also can be exploited in various other drinking vessels or containers.

To the accomplishment of the foregoing and related ends, the subject disclosure, then, comprises the features hereinafter fully described. The following description and the annexed drawings set forth in detail certain illustrative aspects of one or more embodiments of the disclosure. However, these aspects are indicative of but a few of the various ways in which the principles of the subject disclosure may be employed. Other aspects, advantages and novel features of the subject disclosure will become apparent from the following detailed description of various example embodiments of the subject disclosure when considered in conjunction with the drawings.

The present subject disclosure describes multi-mode bottles, often identified as sports bottles, for use by adults, children, and toddlers.

In one exemplary embodiment, the present subject disclosure is a bottle. The bottle includes a container; a cap connected to a top end of the container; and a straw having one open end inside the container and the other open end in a straw port positioned in the cap, wherein the straw further includes an aperture near the cap; wherein the straw port is movable from one position where the straw port is positioned inside the container allowing fluid within the container to flow through the straw aperture, and a second position where the straw port is positioned out of the container and inside the cap where no fluid flows through the straw aperture.

In another exemplary embodiment, the present subject disclosure is a bottle. The bottle includes a container; a cap connected to a top end of the container; and a straw having one open end inside the container and the other open end in a straw port connected to the cap through a movable diaphragm, wherein the straw further includes an aperture near the cap; wherein the straw port is movable from one position where the straw port is pushed inwards into the cap where fluid flows through the straw aperture, and a second position where the straw port is pulled upwards and away from the cap allowing fluid within the container to flow through the straw aperture.

In another exemplary embodiment, the present subject disclosure is a removable valve and lid assembly including a removable valve and a lid. The removable valve can have a pressure valve and a spout. The lid can have a closing structure operable to control access to an opening of the lid and a securing mechanism disposed adjacent to the opening, wherein the securing mechanism is configured to receive and secure the removable valve, and wherein the closing structure includes a protrusion configured to press against the spout of the removable valve when the removable valve is disposed within the opening of the lid and when the closing structure is pressed against the spout.

In another exemplary embodiment, the present subject disclosure is a bottle including a container body, a removable valve, and a lid. The removable valve can have a pressure valve and a spout. The lid can have a closing structure operable to control access to an opening of the lid and a securing mechanism disposed adjacent to the opening, wherein the securing mechanism is configured to receive and secure the removable valve, and wherein the closing structure includes a protrusion configured to press against the spout of the removable valve when the removable valve is disposed within the opening of the lid and when the closing structure is pressed against the spout.

BRIEF DESCRIPTION OF THE DRAWINGS

Various exemplary embodiments of this disclosure will be described in detail, wherein like reference numerals refer to identical or similar components or steps. The accompanying drawings, which are incorporated in and constitute a part of this specification, illustrate embodiments of the subject disclosure and technical data supporting those embodiments, and together with the written description, serve to explain certain principles of the subject disclosure. With reference to the following figures, wherein.

DETAILED DESCRIPTION

The following detailed description references specific embodiments of the subject disclosure and accompanying figures, including the respective best modes for carrying out each embodiment. It shall be understood that these illustrations are by way of example and not by way of limitation. Particular embodiments of a multi-mode bottle will now be described in greater detail with reference to the figures.

The present subject disclosure describes a sports bottle with multiples modes, including storage/closed mode, pour mode, and straw mode. In the storage/closed mode, the bottle is closed off so that if there is any fluid contained within, the fluid is stored and secured within the bottle. In this mode, there would be no spilling or leaking of the fluid outside of the bottle. In the pour mode, the fluid contained inside the sports bottle could be poured out by tilting of the sports bottle. This mode would be used while pouring the contained fluid into another container, such as a cup or glass, or pouring the fluid out. In the straw mode, the contained fluid may be sucked straight out of the sports bottle as the bottle is held substantially upright. This would eliminate the need for another container in which to pour the contained fluid before consumption.

Figure 1:
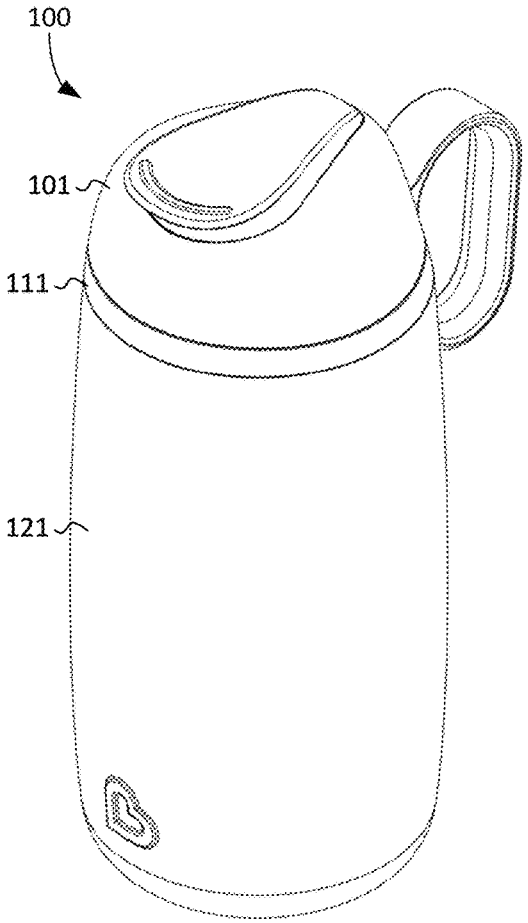
FIG. 1 shows a perspective view of a multi-mode sports bottle with a plastic handle, in accordance with some aspects of the present disclosure.
Figure 2:
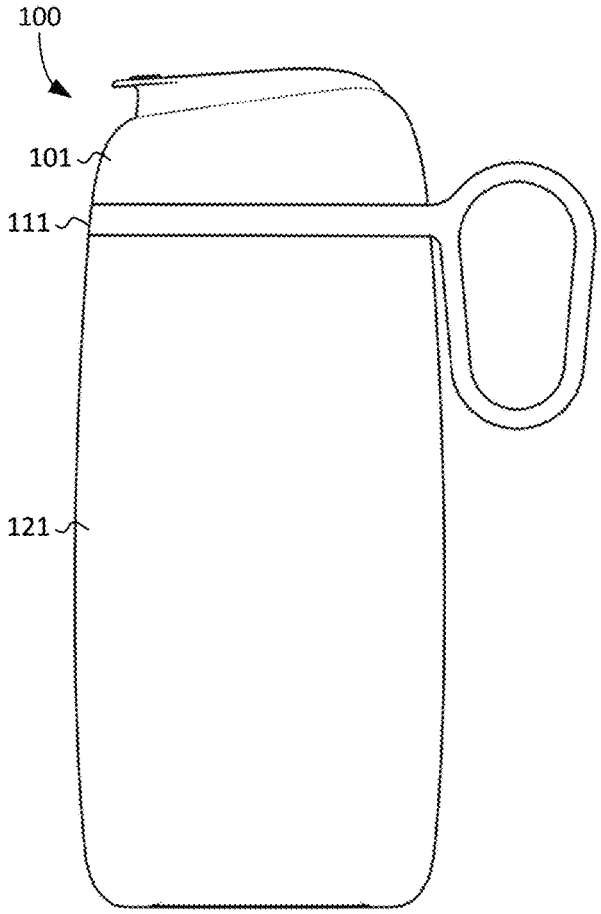
FIG. 2 shows a side view of a multi-mode sports bottle with a plastic handle, in accordance with some aspects of the present disclosure.
Figure 3:
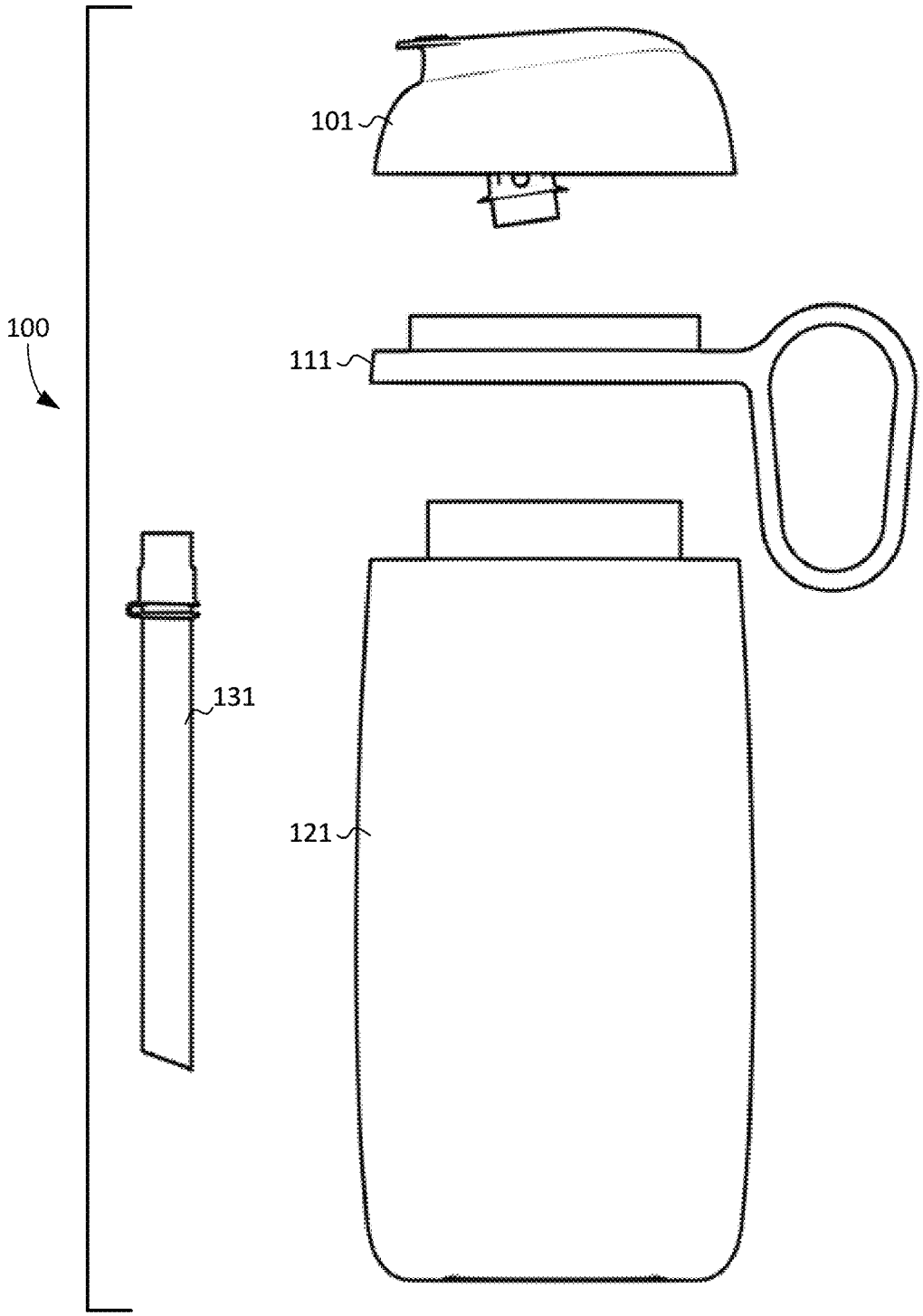
FIG. 3 shows an exploded view of a multi-mode sports bottle with a plastic handle, in accordance with some aspects of the present disclosure.

FIGS. 1-3 show various views of a versatile multi-mode bottle 100 with plastic handle. More specifically, FIG. 1 is a perspective view of a versatile multi-mode bottle 100, FIG. 2 is a side view of a of a versatile multi-mode bottle 100, and FIG. 3 is an exploded view of a versatile multi-mode bottle 100.

FIGS. 1-3 show the secured or closed mode, in which any fluid contained within multi-mode bottle 100 is secured within, and will not pour, leak, or spill. The multi-mode bottle 100 includes a top cap 101, a handle assembly 111, a bottom container 121, and a straw 131. The handle assembly 111 may be made of hardened plastic or other suitable material.

Figure 4:
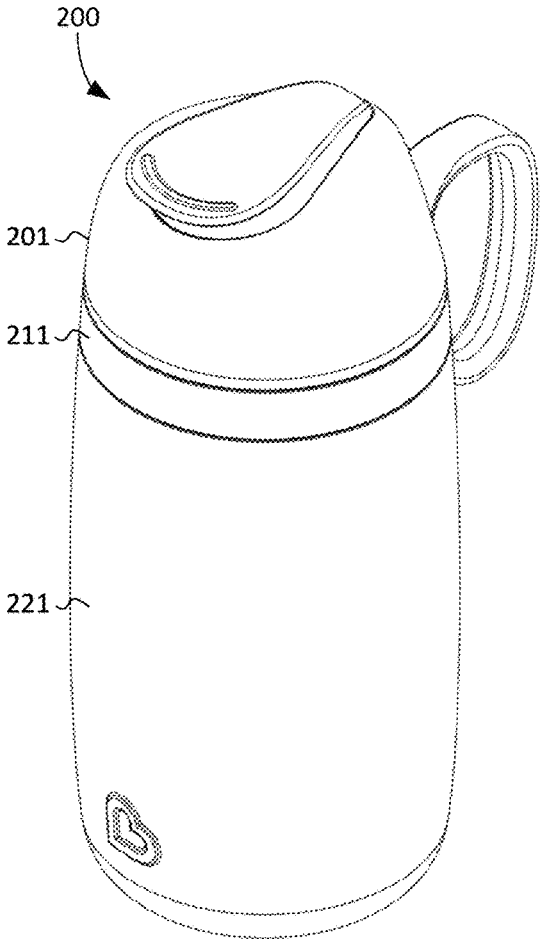
FIG. 4 shows a perspective view of a multi-mode sports bottle with a silicone handle, in accordance with some aspects of the present disclosure.
Figure 5:
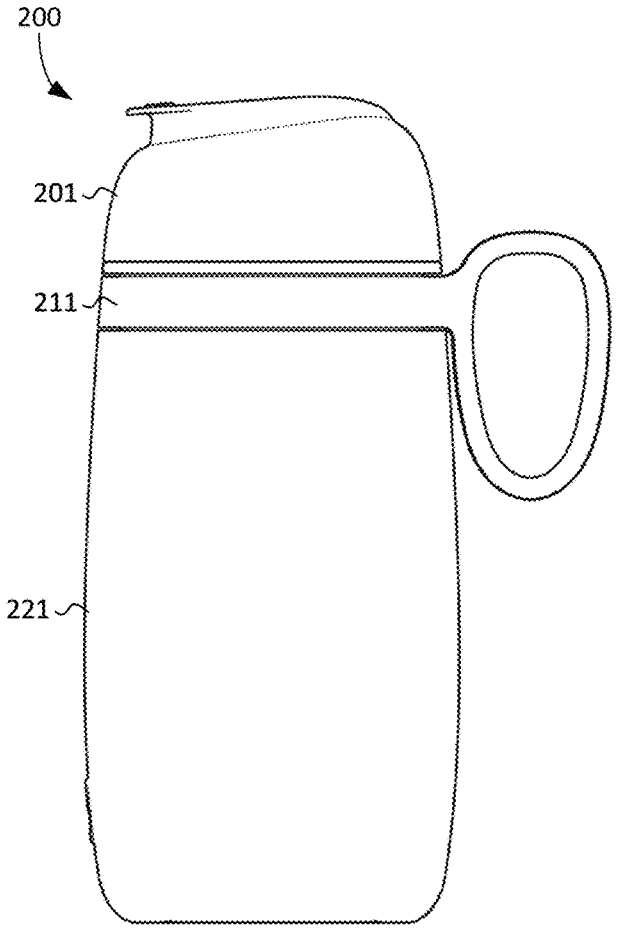
FIG. 5 shows a side view of a multi-mode sports bottle with a silicone handle, in accordance with some aspects of the present disclosure.
Figure 6:
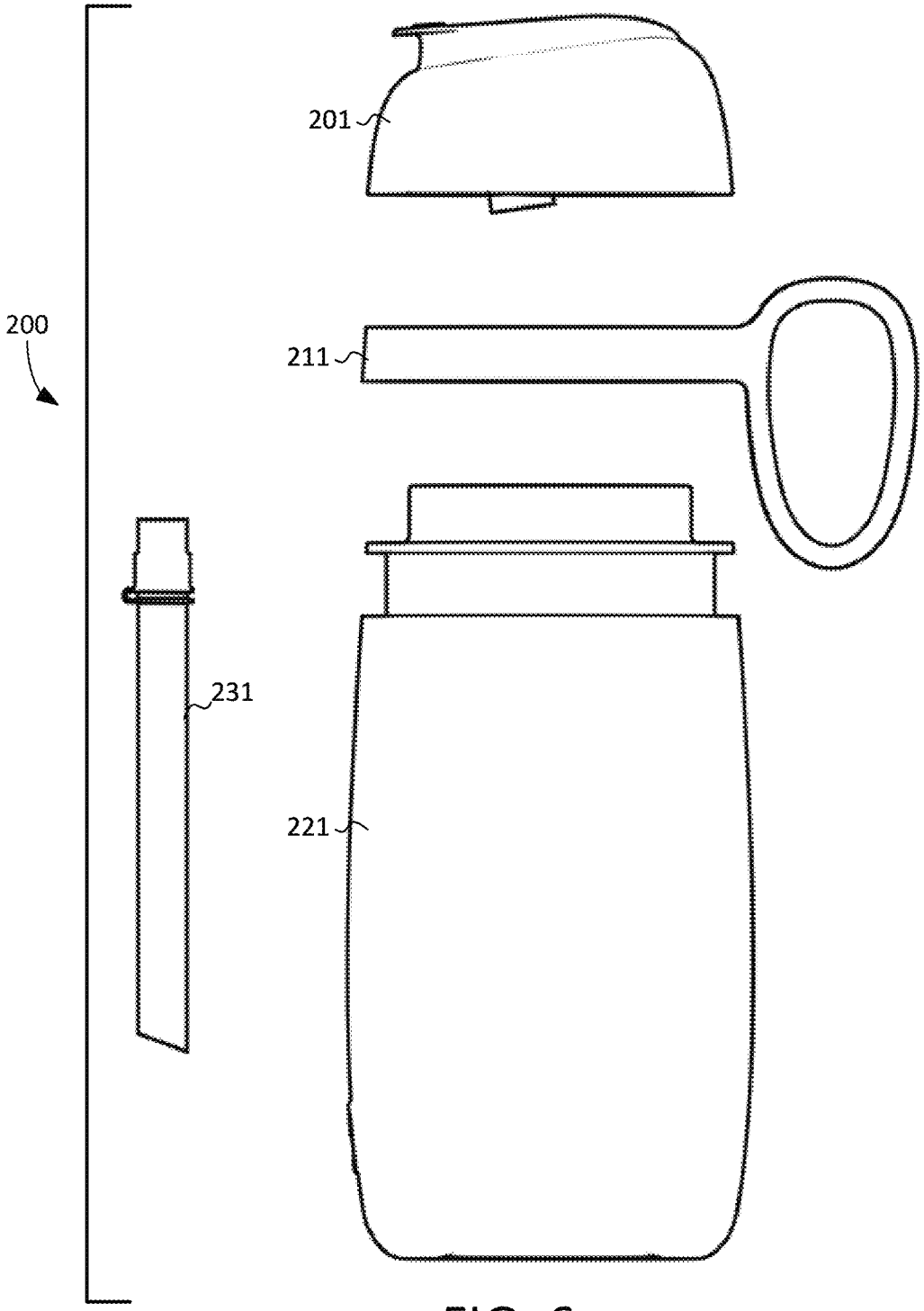
FIG. 6 shows an exploded view of a multi-mode sports bottle with a silicone handle, in accordance with some aspects of the present disclosure.

FIGS. 4-6 show various views of a versatile multi-mode bottle 200 with a silicone handle. More specifically, FIG. 4 is a perspective view of a versatile multi-mode bottle 200, FIG. 5 is a side view of a versatile multi-mode bottle 200, and FIG. 6 is an exploded view of a versatile multi-mode bottle 200.

FIGS. 4-6 show the secure mode, in which any fluid contained within multi-mode bottle 200 is secured within, and will not pour, leak, or spill. The multi-mode bottle 200 includes a top cap 201, a handle assembly 211, a bottom container 221, and a straw 231. The handle portion 211 may be made of hardened silicone or other suitable material.

As illustrated, the embodiments shown in FIGS. 1-3 and FIGS. 4-6 have different handles. However, the premise of multi-mode use for the multi-mode bottles is substantially the same.

Figure 7:
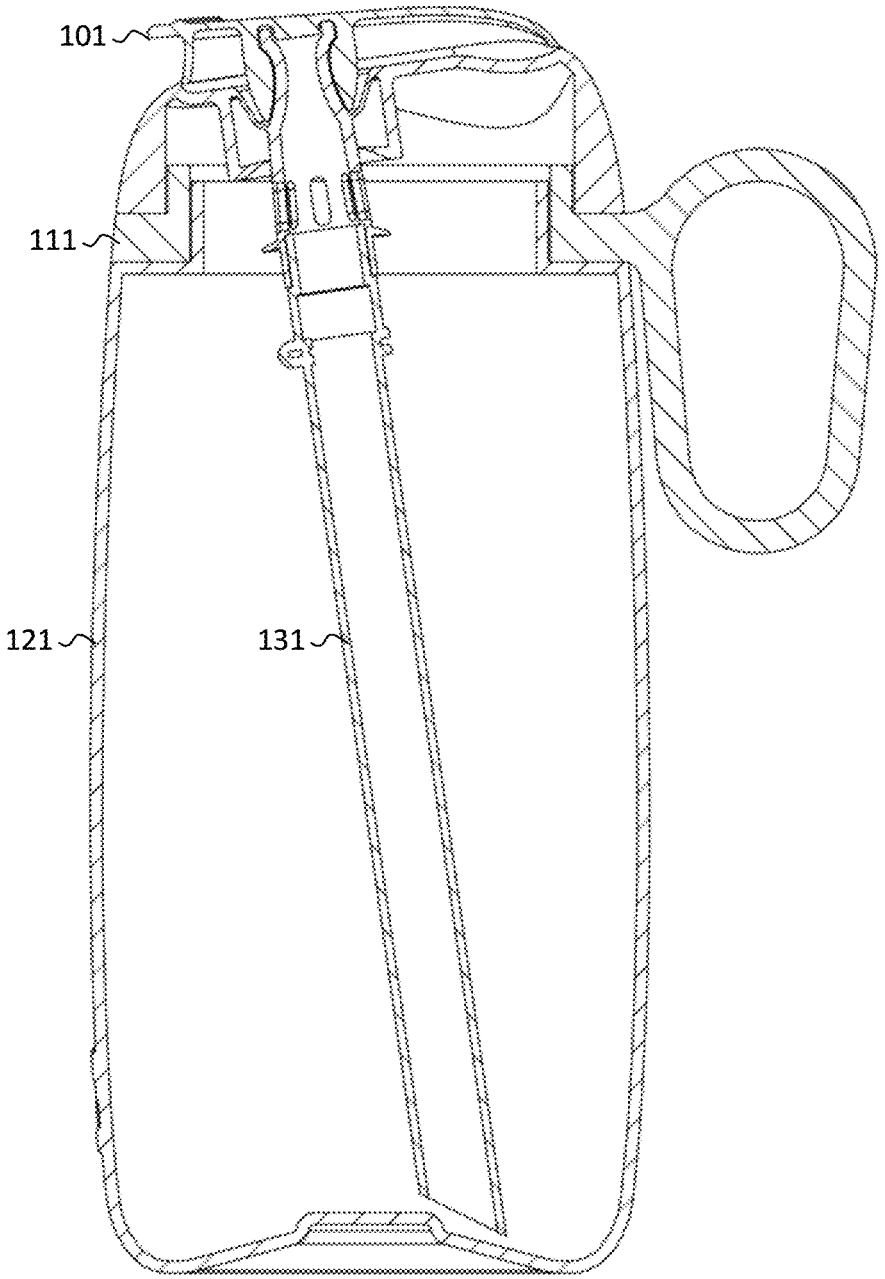
FIG. 7 shows a cross sectional view of a multi-mode sports bottle in a storage mode, in accordance with some aspects of the present disclosure.

FIG. 7 shows a cross sectional view of multi-mode bottle 100 in a closed mode. As shown in the drawing, top cap 101 presses against and secures the top portion of the straw assembly 131 in the closed mode or position.

Figure 8:
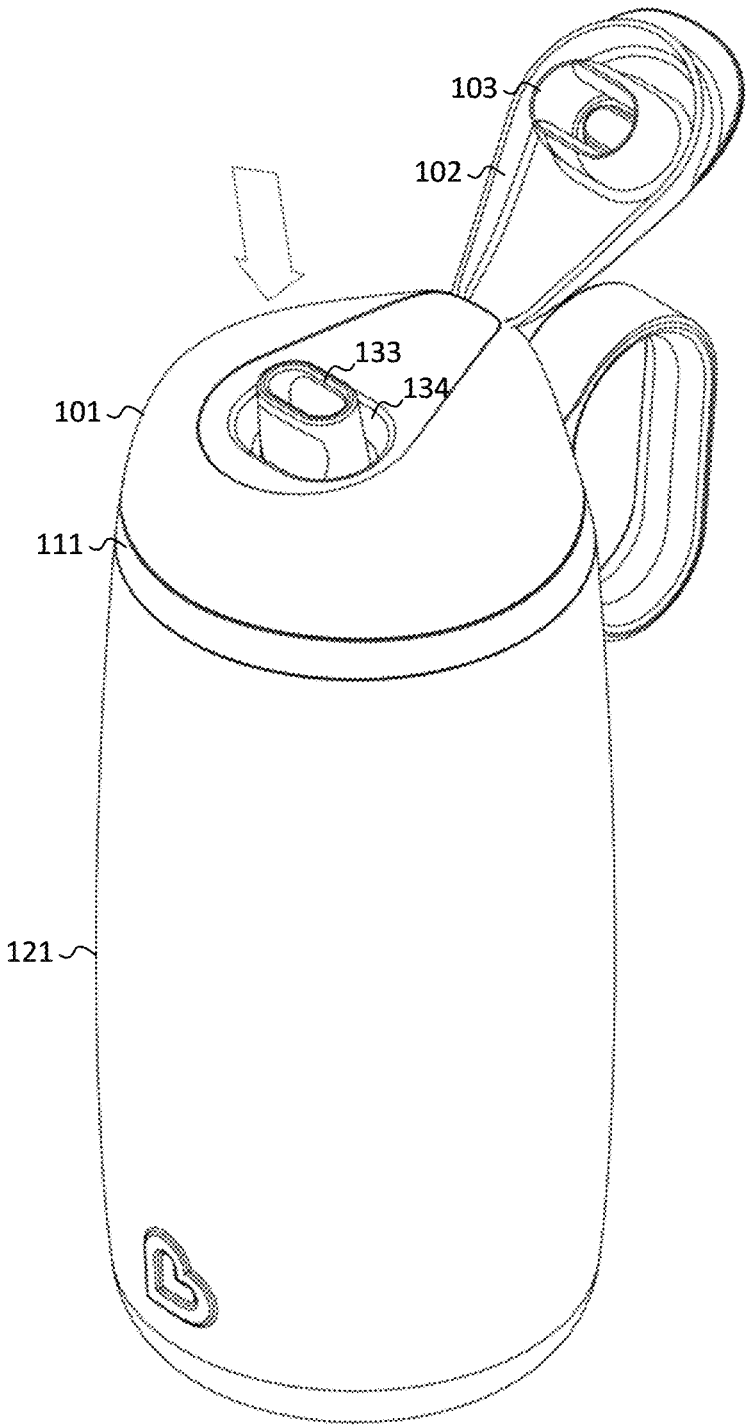
FIG. 8 shows a perspective view of a multi-mode sports bottle in a pour mode, in accordance with some aspects of the present disclosure.
Figure 9:
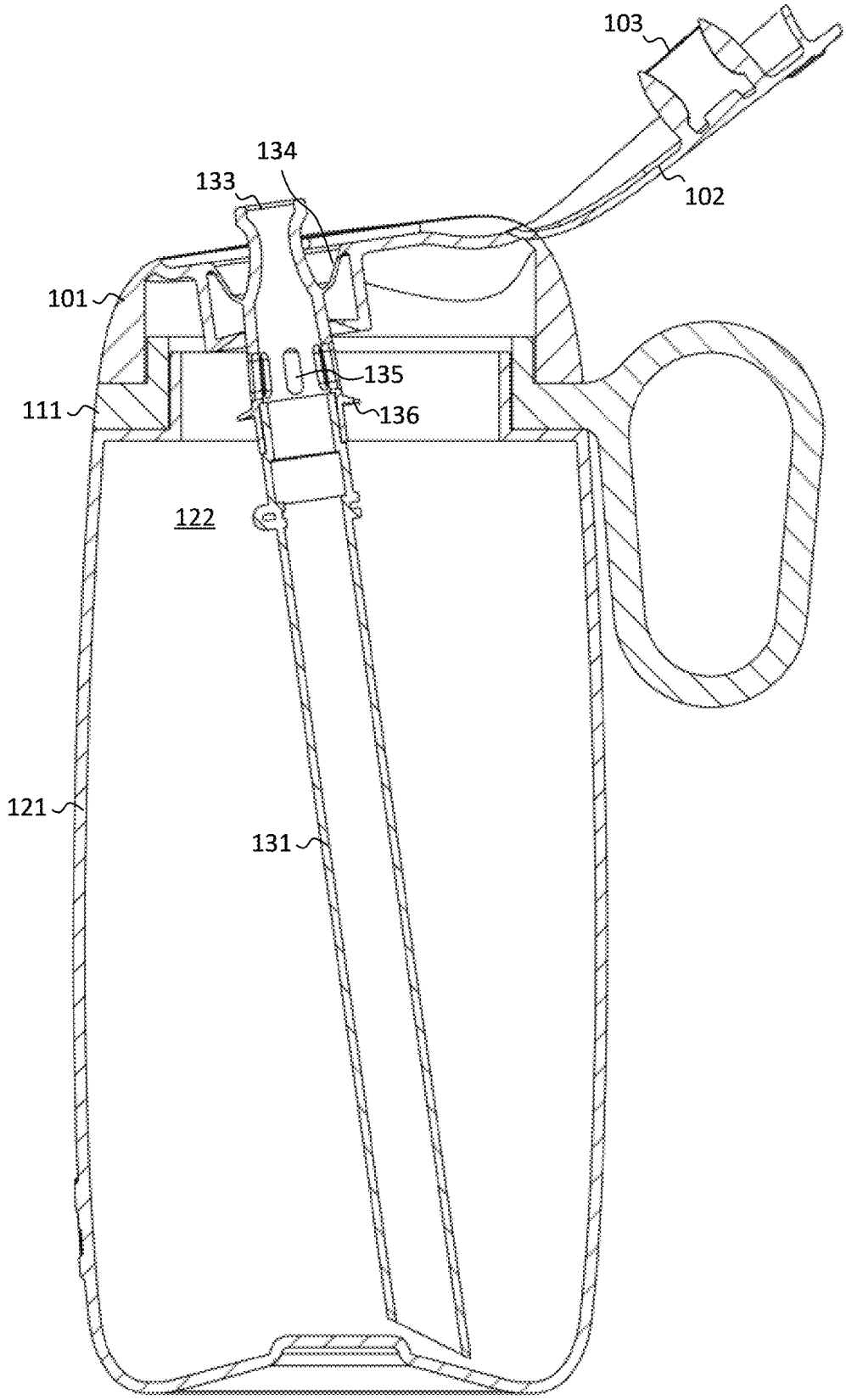
FIG. 9 shows a cross sectional view of a multi-mode sports bottle in a pour mode, in accordance with some aspects of the present disclosure.
Figure 10:
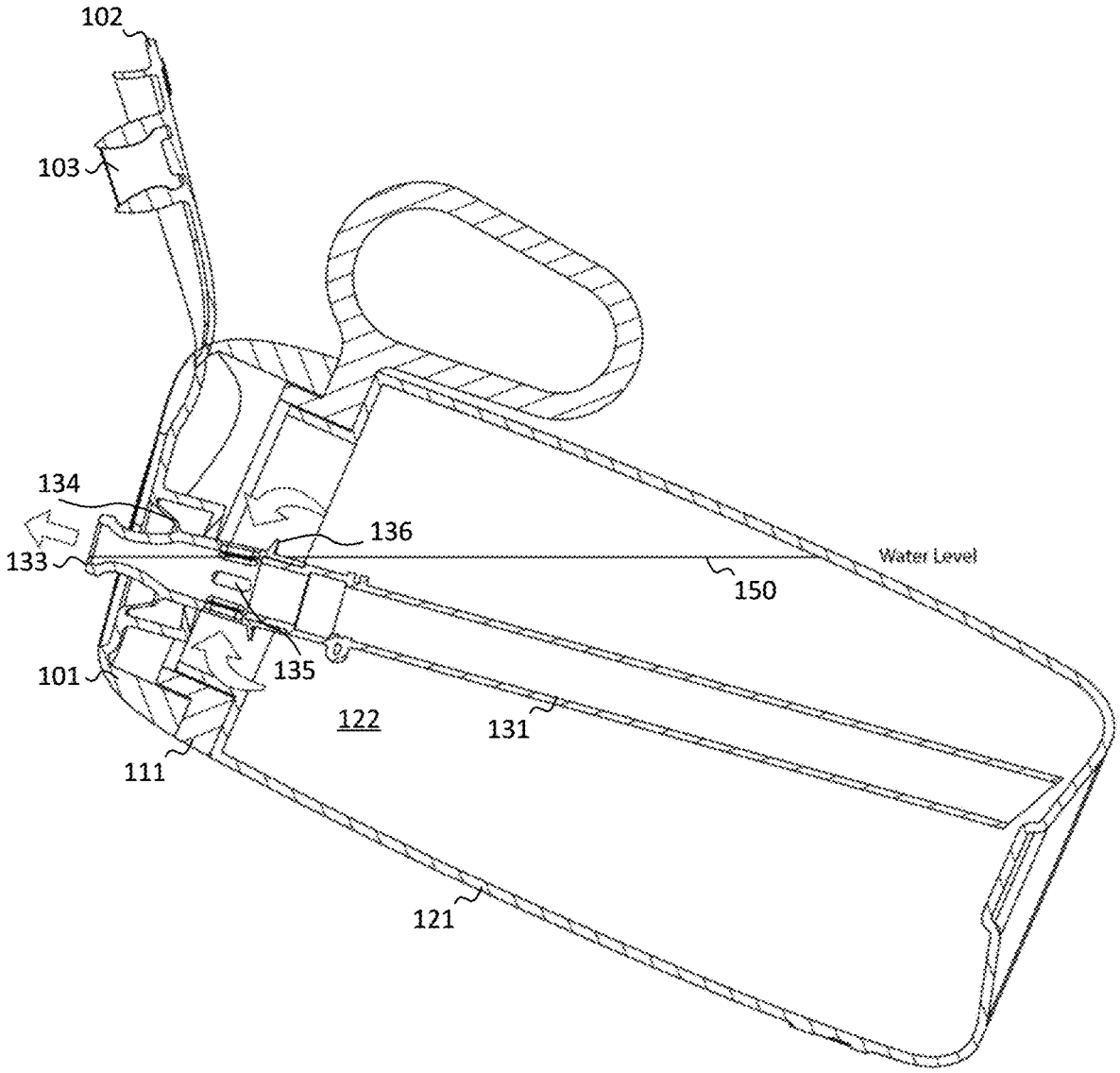
FIG. 10 shows a cross sectional view of a multi-mode sports bottle in a pour mode during pouring, in accordance with some aspects of the present disclosure.

FIGS. 8-10 show various views of the multi-mode bottle 100 in a pour mode. More specifically, FIG. 8 illustrates a perspective view of the multi-mode bottle 100 in the pour mode, FIG. 9 illustrates a cross sectional view of the multi-mode bottle 100 in the pour mode, and FIG. 10 illustrates a cross sectional view of the multi-mode bottle 100 in the pour mode.

In this mode, a flap 102 extends from a top portion of the top cap 101. The flap 102 can be opened up to reveal a seal cap 103 disposed on a lower surface of the flap 102. Seal cap 103 is adapted to mate with a straw port 133, which is the external opening through which fluid exits the container 121.

The top cap 101 can have a resilient diaphragm 134 disposed thereon. In the pour mode shown, the resilient diaphragm 134 allows the straw cap 133 to pop up and down as needed to alternate between the straw and pour modes, respectively.

As shown in the cross sectional view of FIG. 9, the resilient diaphragm 134 is tucked inside the top portion of top cap 101 while in pour mode. This position allows the straw body apertures 135 open access to the interior 122 of the container 121. As shown in FIG. 10, when the bottle is turned to pour out a fluid from within the container 121, the fluid level 150 allows the fluid to flow from within the container 121, through the apertures 135 and out the straw port 133. Thus, the interior of the straw 131 has little effect since the apertures 135 in the straw 131 allow fluid flow therethrough, and the fluid is thereby poured out of the container 121.

Figure 11:
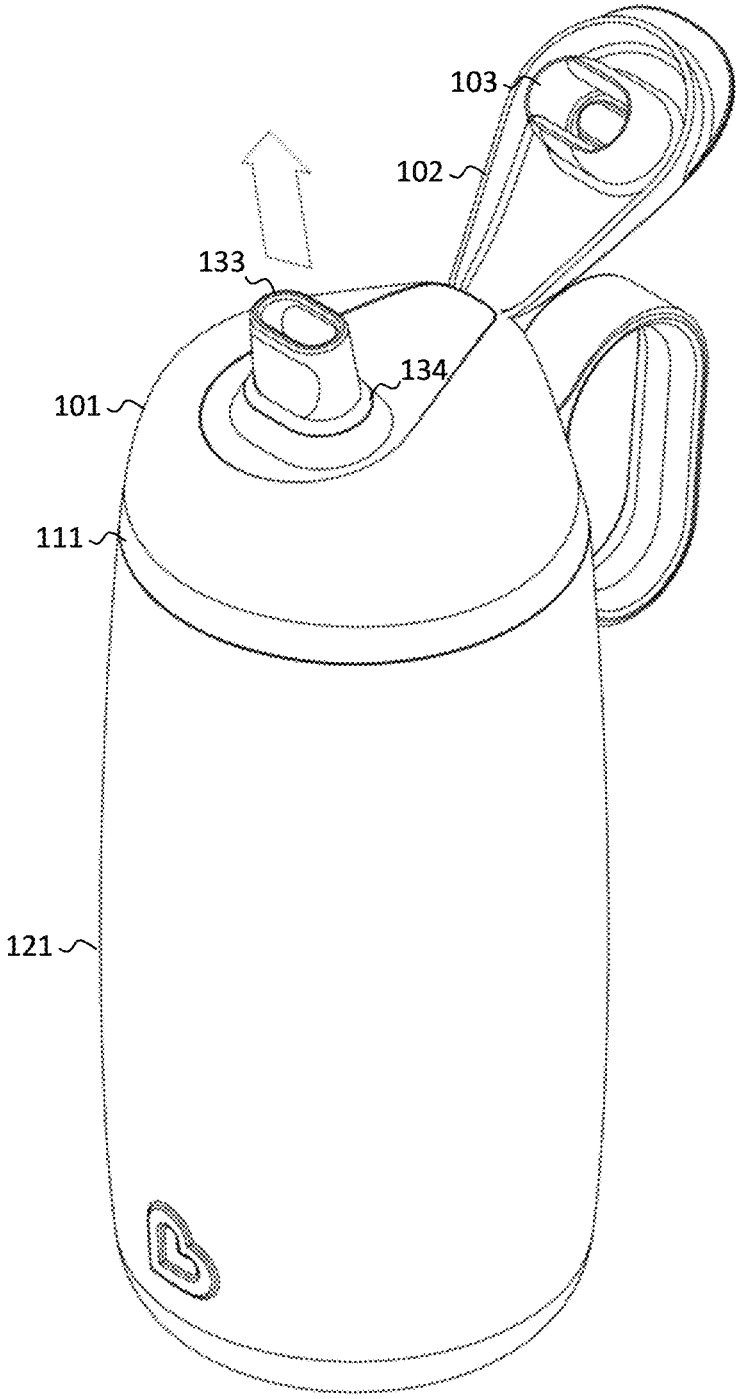
FIG. 11 shows a perspective view of a multi-mode sports bottle in a straw mode, in accordance with some aspects of the present disclosure.
Figure 12:
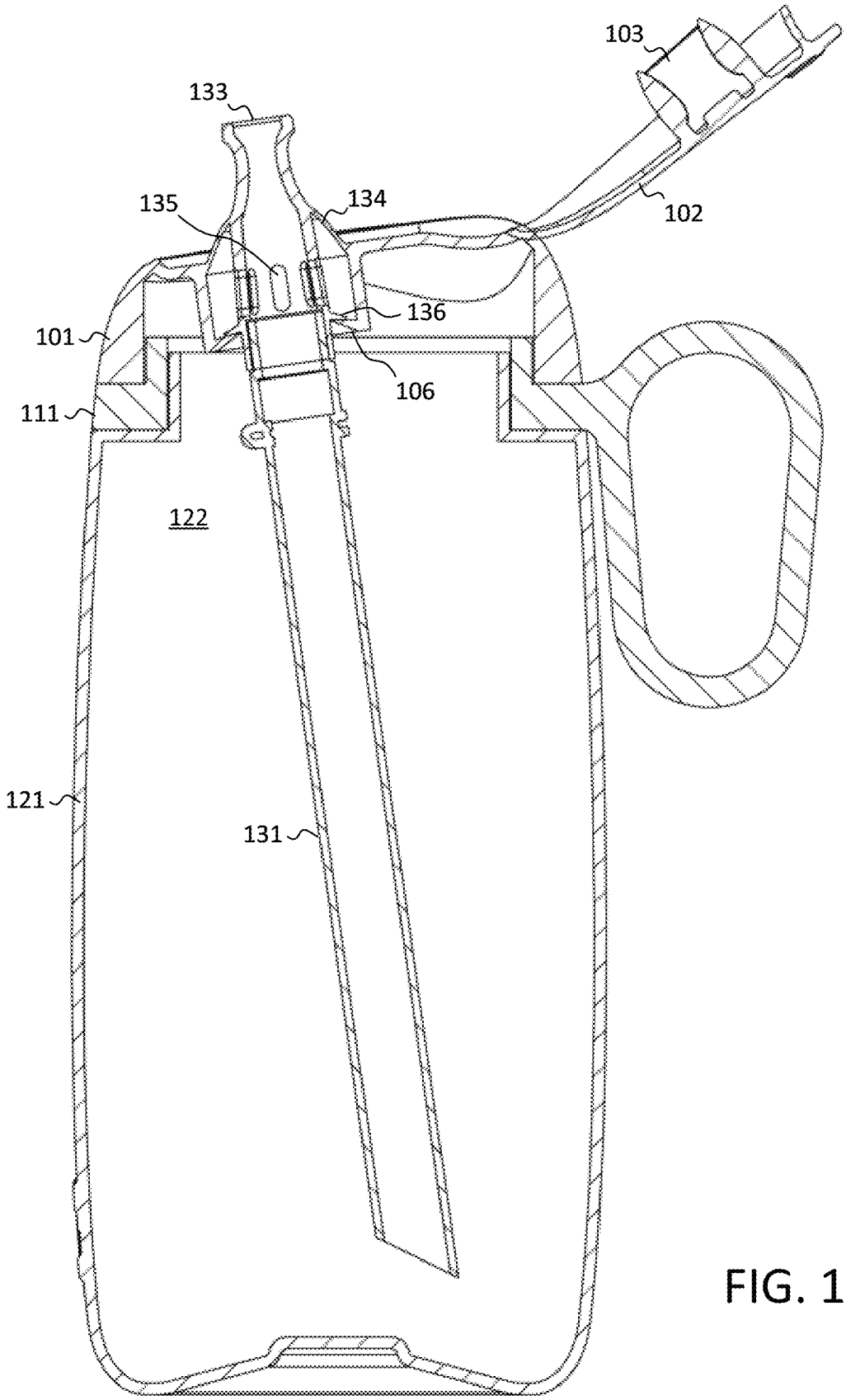
FIG. 12 shows a cross sectional view of a multi-mode sports bottle in a straw mode, in accordance with some aspects of the present disclosure.
Figure 13:
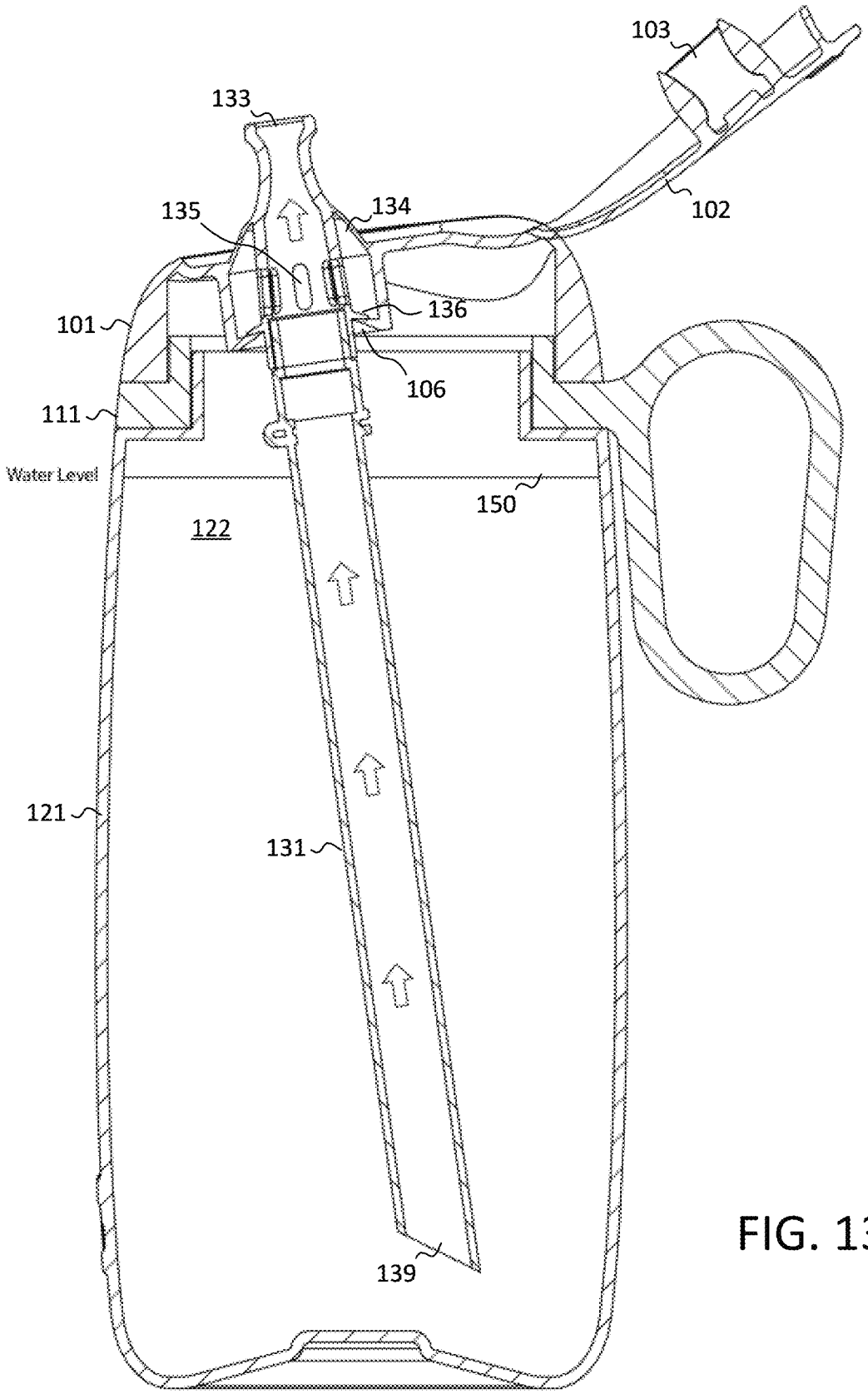
FIG. 13 shows a cross sectional view of a multi-mode sports bottle in a straw mode during use, in accordance with some aspects of the present disclosure.

FIGS. 11-13 show various views of the straw mode of the multi-mode bottle 100 in use. More specifically, FIG. 11 is a perspective view of the straw mode of the multi-mode bottle 100 in use, FIG. 12 is a cross sectional view of the straw mode of the multi-mode bottle 100, and FIG. 13 is a cross sectional view of the straw mode of the multi-mode bottle 100 in use.

In this mode, the flap 102 is secured on the top portion of the top cap 101 and is opened up to reveal seal cap 103. Seal cap 103 mates with the straw port 133, which is the external opening through which fluid exits the container 121. In the straw mode shown, a resilient diaphragm 134 allows the straw cap 133 to pop up and down as needed to alternate between the straw and pour modes, respectively.

As shown in cross sectional view of FIG. 12, resilient diaphragm 134 is pulled above the top portion of top cap 101 while in straw mode. This position pulls the entire straw body 131 up and pulls the straw body apertures 135 above and out of the interior 122 of the container 121. A bottom seal wedge 136 on the straw body 131 is pulled above a cap ledge 106 thereby keeping the apertures 135 sealed and outside the interior 122 of the container 121.

FIG. 13 shows the formation of negative pressure as the straw port 133 is sucked on to pull up the fluid contained within the container 121, the fluid level 150 allows the fluid to flow from within the container 121, through the straw end aperture 139 and out the straw port 133. Thus, the straw body apertures 135, which were instrumental in the pour mode, have no effect in the straw mode (since the apertures 135 are not part of the flow of fluid between the straw end aperture 139 and straw port 133.

Figure 14:
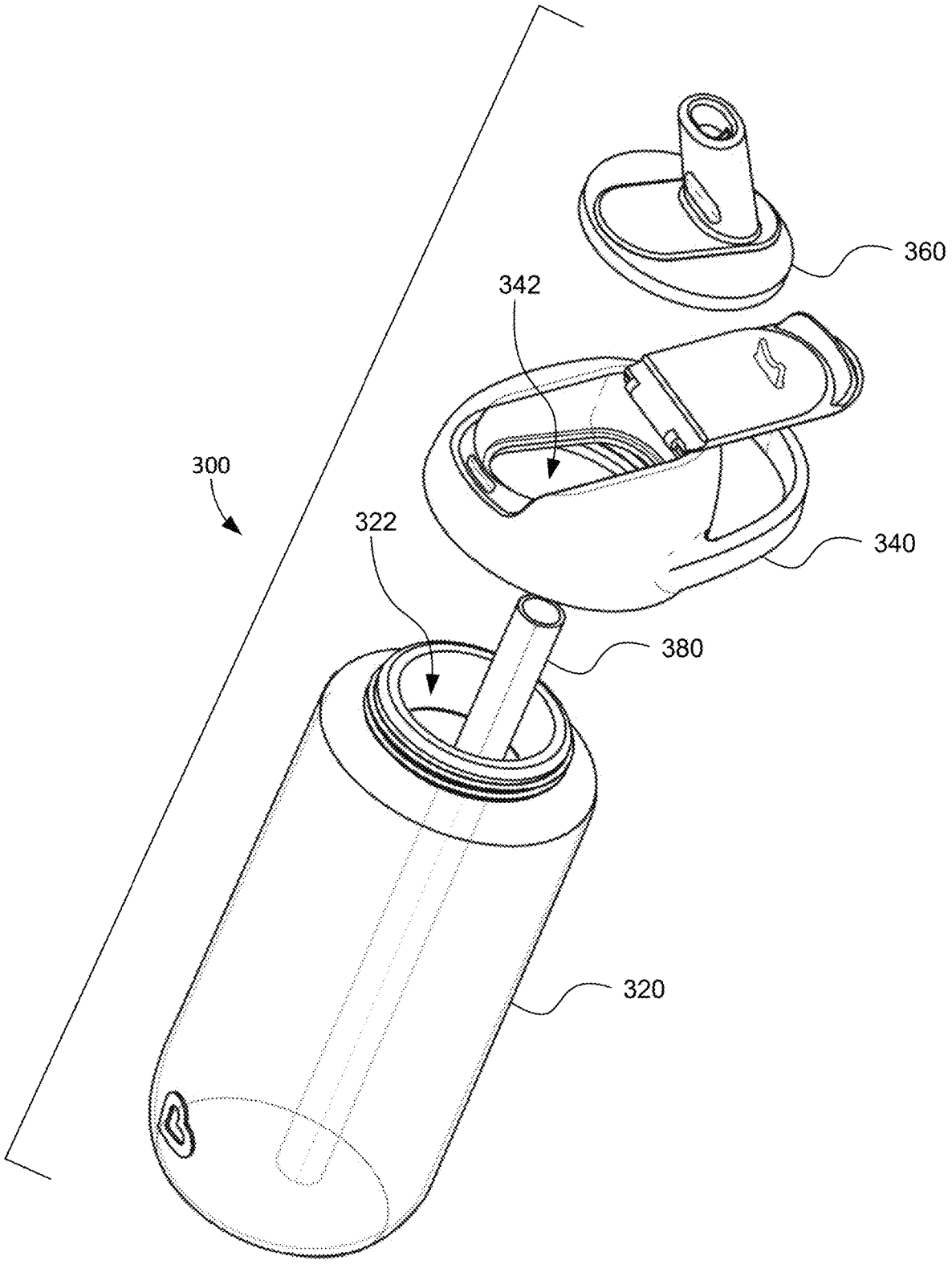
FIG. 14 is an exploded view of a bottle, in accordance with some aspects of the present disclosure.

FIG. 14 is an exploded view of a bottle 300, in accordance with some aspects of the present disclosure. Bottle 300 can include a bottle body 320, a lid 340, a removable valve 360, and a straw 380. Bottle body 320 can include a cavity 322 to receive contents therethrough for placement within bottle body 320. Lid 340 can include an opening 342 to receive at least a portion of removable valve 360.

Figure 15:
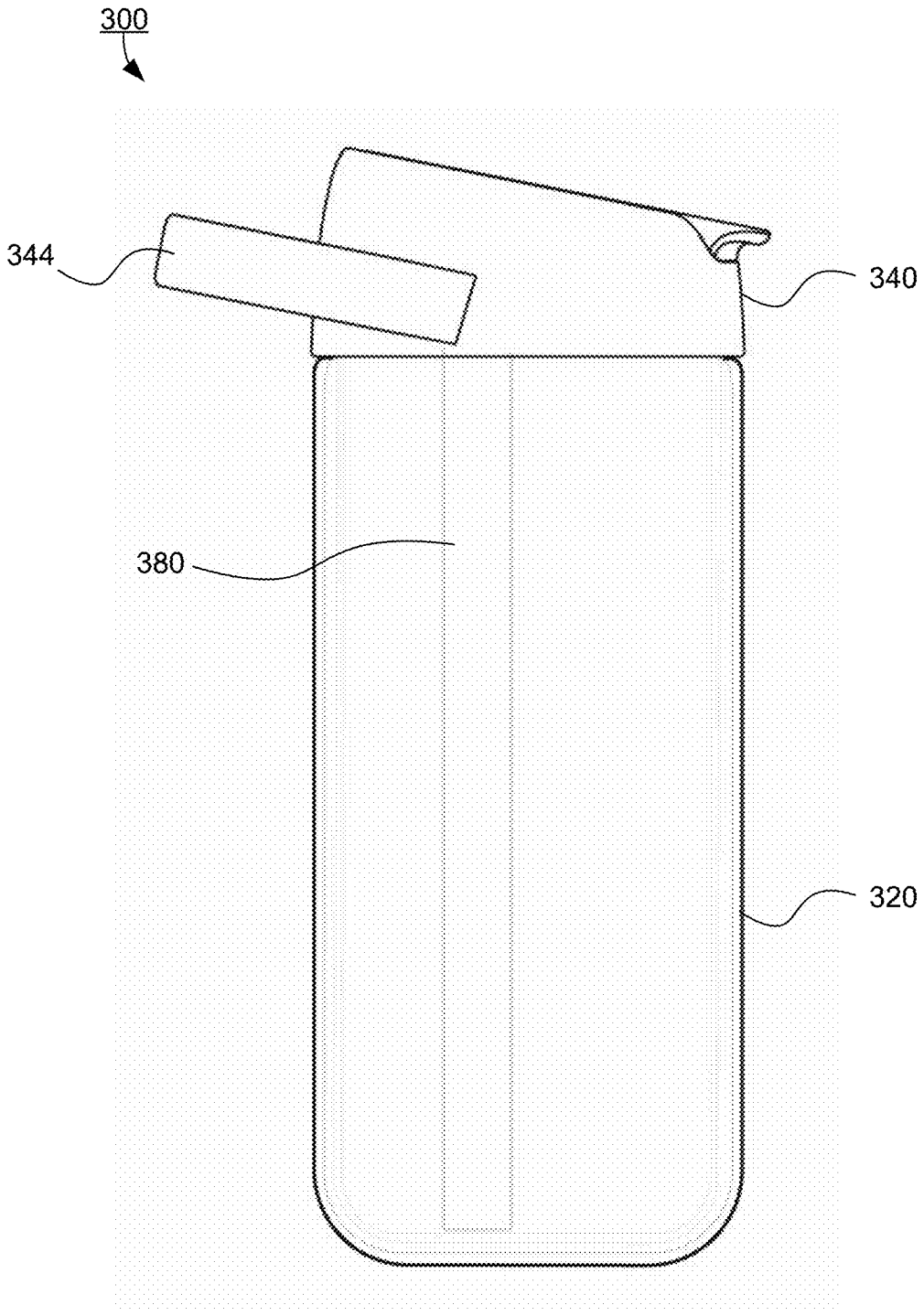
FIG. 15 shows a side view of the bottle 300 in the closed configuration, in accordance with some aspects of the present disclosure.
Figure 16:
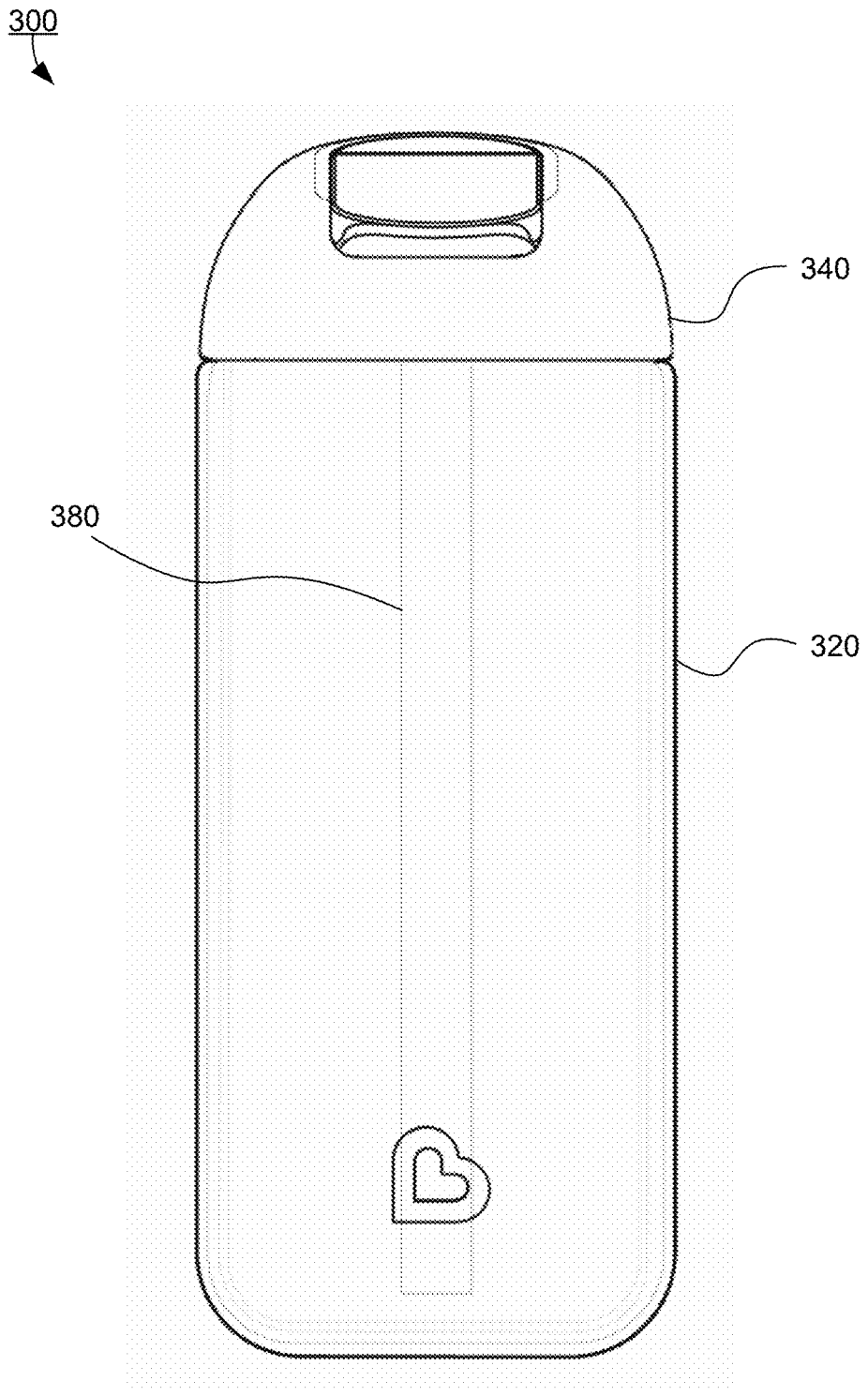
FIG. 16 shows a front view of the bottle 300 in the closed configuration, in accordance with some aspects of the present disclosure.
Figure 17:
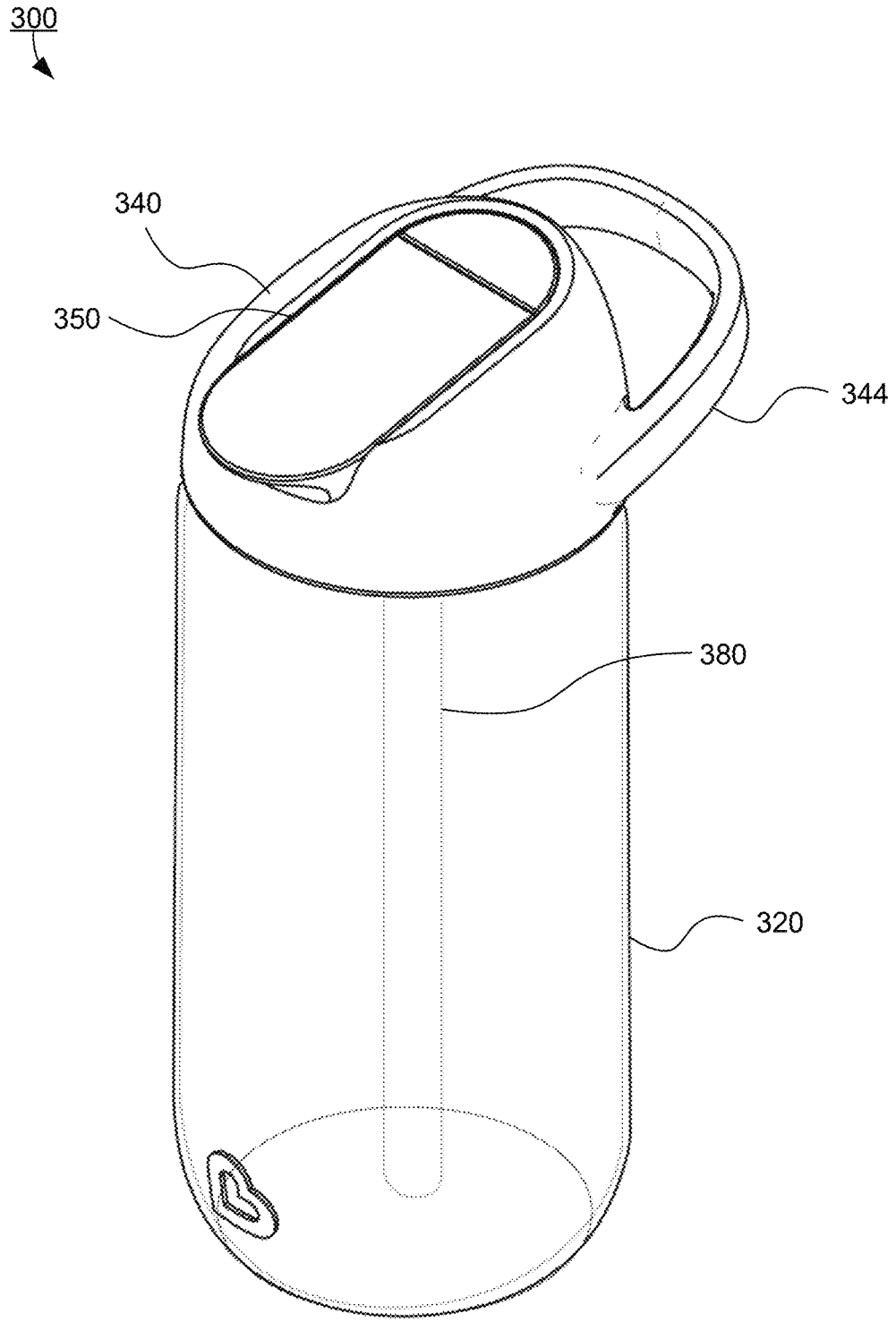
FIG. 17 shows an upper perspective view of the bottle 300 in the closed configuration, in accordance with some aspects of the present disclosure.
Figure 18:
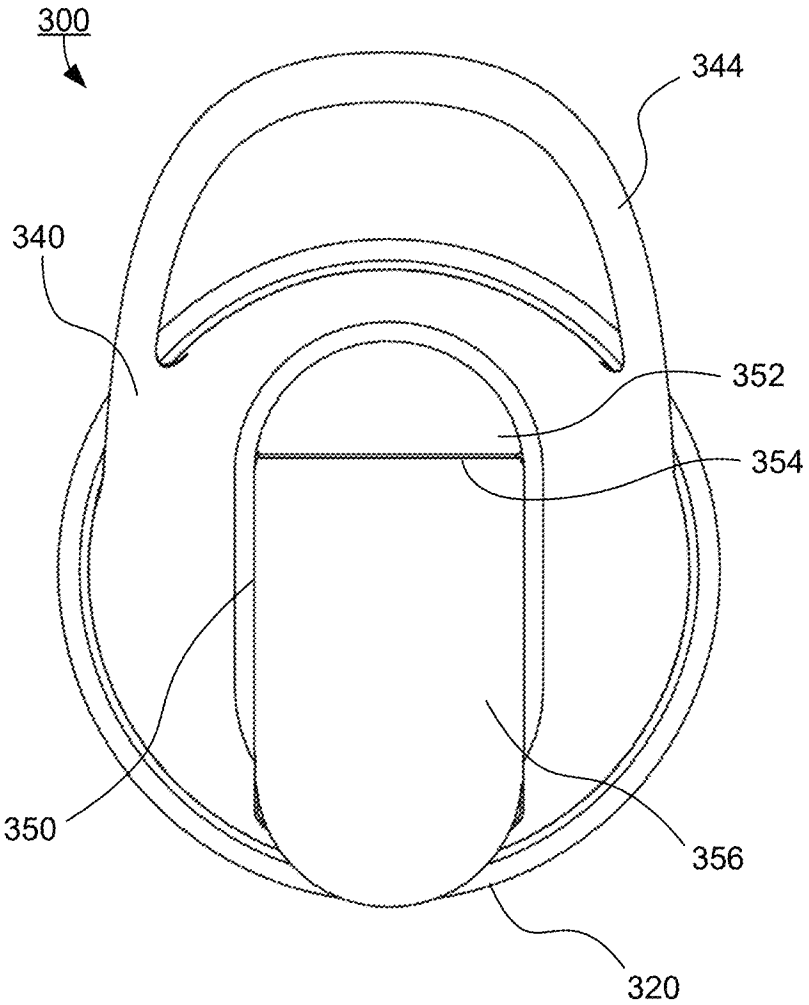
FIG. 18 shows a top view of the bottle 300 in the closed configuration, in accordance with some aspects of the present disclosure.

FIGS. 15-18 show various views of a bottle 300 in a closed configuration, in accordance with some aspects of the present disclosure. More specifically, FIG. 15 shows a side view of the bottle 300 in the closed configuration, FIG. 16 shows a front view of the bottle 300 in the closed configuration, FIG. 17 shows an upper perspective view of the bottle 300 in the closed configuration, and FIG. 18 shows a top view of the bottle 300 in the closed configuration.

Lid 340 may include opening 342 (as depicted in FIG. 14), a handle 344, and a closing structure 350. Closing structure 350 can include a base portion 352 connected to lid 340. Closing structure 350 may also include a hinge 354 securing flap 356 to base portion 352. Hinge 354 is operable to allow flap 356 to transition between a closed position (e.g., as shown in FIGS. 15-18) and an open position (e.g., as shown in FIGS. 19-22). In the closed configuration, flap 356 may press downwards against lid 340 and prevent fluids from flowing therethrough.

Figure 19:
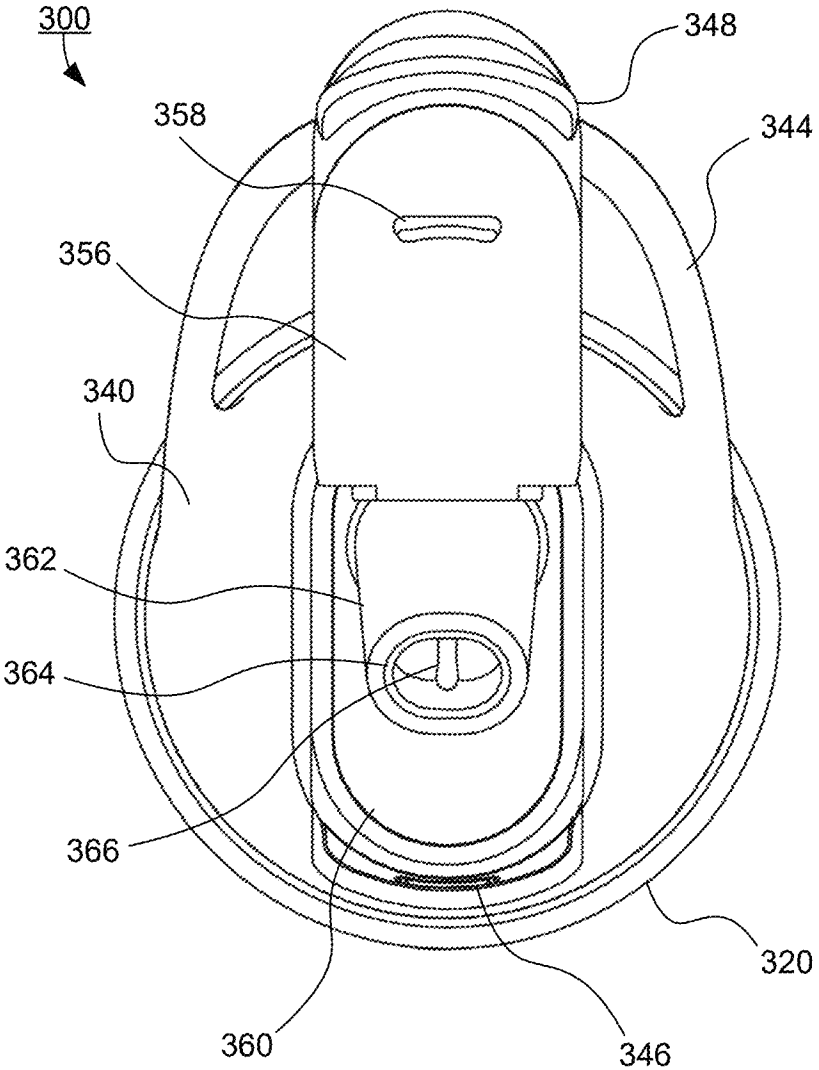
FIG. 19 shows a top view of the bottle 300 in the open configuration, in accordance with some aspects of the present disclosure.
Figure 20:
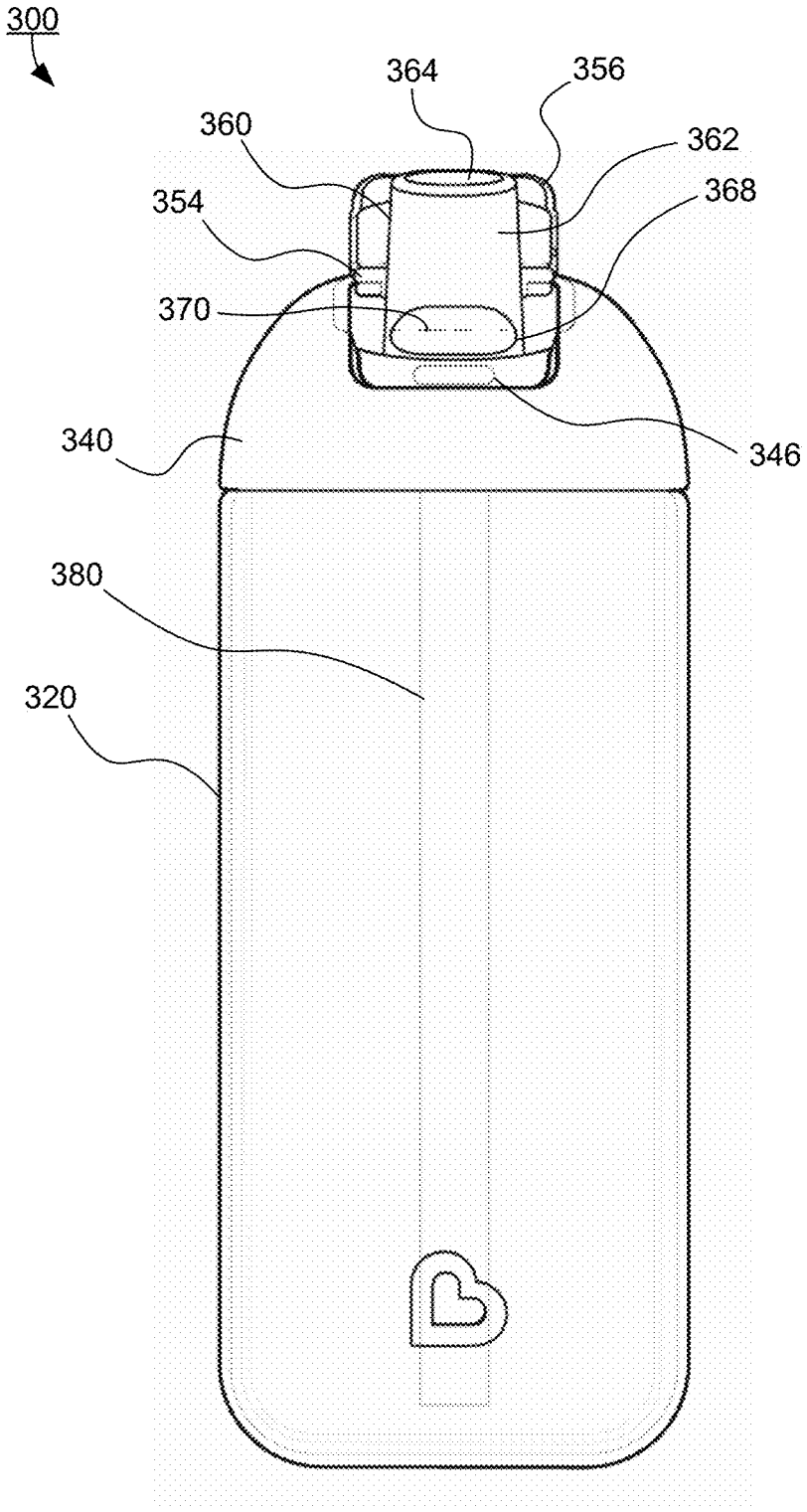
FIG. 20 shows a front view of the bottle 300 in the open configuration, in accordance with some aspects of the present disclosure.
Figure 21:
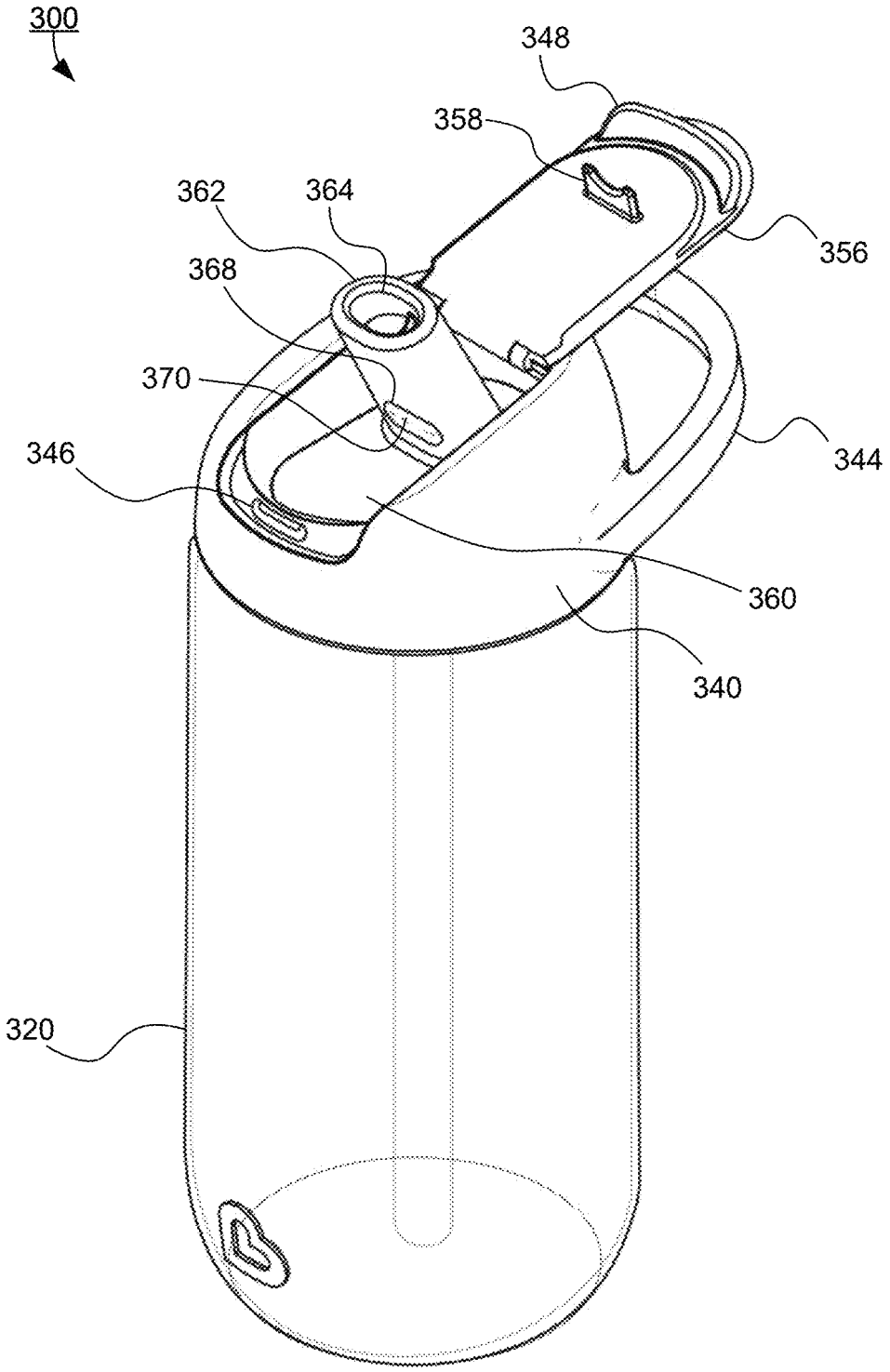
FIG. 21 shows an upper perspective view of the bottle 300 in the open configuration, in accordance with some aspects of the present disclosure.
Figure 22:
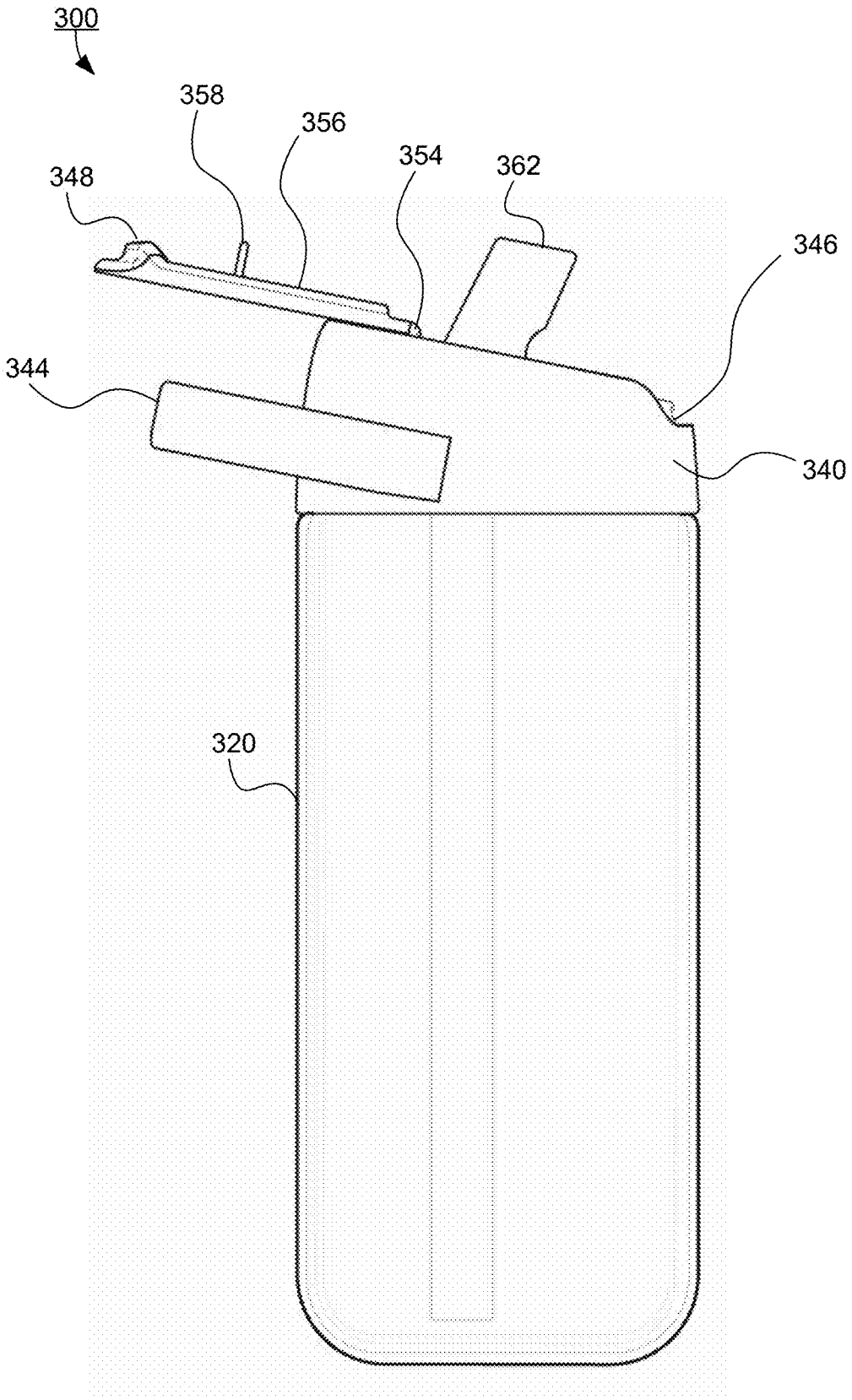
FIG. 22 shows a side view of the bottle 300 in the open configuration, in accordance with some aspects of the present disclosure.

FIGS. 19-22 show various views of a bottle 300 in an open configuration, in accordance with some aspects of the present disclosure. More specifically, FIG. 19 shows a top view of the bottle 300 in the open configuration, FIG. 20 shows a front view of the bottle 300 in the open configuration, FIG. 21 shows an upper perspective view of the bottle 300 in the open configuration, and FIG. 22 shows a side view of the bottle 300 in the open configuration.

As shown in FIGS. 19-22, closing structure 350 can also include a locking protrusion 348 configured to mate with a locking recess 346 of lid 340. For example, locking protrusion 348 may extend away from flap 356, while locking recess 346 may be disposed next adjacent to recess 322, such that locking recess 346 is operable to receive locking protrusion 348 when flap 356 is in the closed position.

Closing structure 350 can also include a closing protrusion 358. Closing protrusion 358 can extend away from flap 356 and be positioned on flap 356 to push against spout 362 of valve 360 when flap 356 is pushed downwards (e.g., into the closed position).

Removable valve 360 may be constructed of a semi-rigid material configured to flex under force. For example, removable valve 360 may be constructed of silicone to allow flexing when inserting and/or removing removable valve 360 from lid 340.

Removable valve 360 may also have a spout 362 extending therefrom. Spout 362 may also be constructed of a semi-rigid material configured to flex under force. For example, spout 362 may be constructed of silicone to allow flexing when pushed by closing protrusion 358 of flap 356. Spout 356 can also include a drinking aperture 365 having a spout valve 366 disposed therein. Spout valve 366 may be operable to allow fluid movement therethrough when spout 356 receives sufficient force. For example, spout 356 may be constructed of silicone to allow flexing, such that when a user bites on spout 356, spout valve 366 can flex open to allow fluid therethrough. As another example, when a user sucks on the straw, spout valve 366 can again flex open to allow fluid therethrough.

Spout 362 may include a flexing portion 368 operable to allow flexing of spout 362. Flexing portion 368 may be a narrower portion of spout 362, such that spout 362 can bend at a flexing line 370 of flexing portion 368 when receiving downward pressure.

Figure 23:
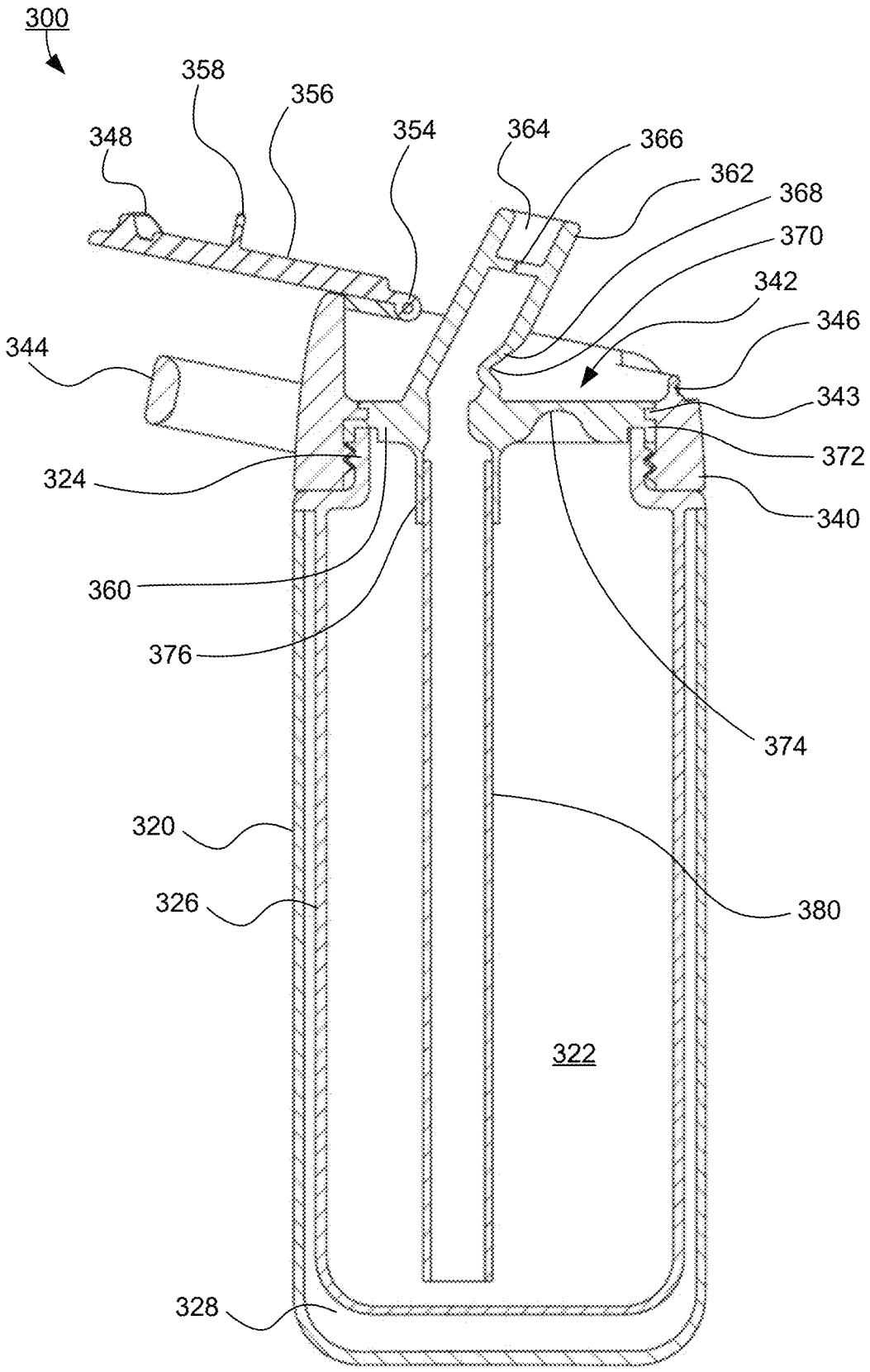
FIG. 23 is a cross-sectional diagram of a bottle in an open configuration, in accordance with some aspects of the present disclosure.

FIG. 23 is a cross-sectional diagram of a bottle 300 in an open configuration, in accordance with some aspects of the present disclosure. Removable valve 360 is secured to lid 340 and further secured by container body 320.

Lid 340 can include securing mechanism 343 configured to removably receive and secure securing portion 372 of removable valve 360. For example, securing mechanism 343 may be an annular protrusion extending inwards into opening 342. Securing portion 372 may include an annular recess configured to mate with the annular protrusion, thereby securing removable valve 360 to lid 340.

An upper portion 324 of container body 320 can be configured to mate with lid 340 to seal container 300 (e.g., via mating threads). Additionally, lid 340 can be constructed to position securing portion 372 of removable valve 360 between lid 340 and upper portion 324 of container body. As discussed above, removable valve 170 may be constructed of a semi-rigid material configured to flex under force. For example, removable valve 360 may be constructed of silicone to allow flexing when inserting and/or removing removable valve 360 from lid 340. To remove the removable valve from lid 340, a user can press the removable valve from the top to push removable valve free from lid 340 when lid 340 is disengaged from container body 110.

Removable valve 360 may also prevent liquid from seeping between container body 320 and lid 340 (e.g., by acting as an O-ring or seal).

Removable valve 360 can also include a pressure valve 374 operable to allow air therethrough. More specifically, pressure valve 374 is configured to flex open to allow air therethrough with sufficient suction. For example, as a user drinks from spout 362, fluid is drawn from a cavity 322 of container body 320 into straw 380 and through spout 362 (e.g., through spout valve 366 when open). As the fluid is drawn from the cavity, negative pressure forms within the cavity of container body 320, causing pressure valve 374 to flex inwards. As pressure valve 374 flexes, air flows therethrough until the pressure inside the cavity and outside of container body 320 reaches equilibrium.

Figure 24:
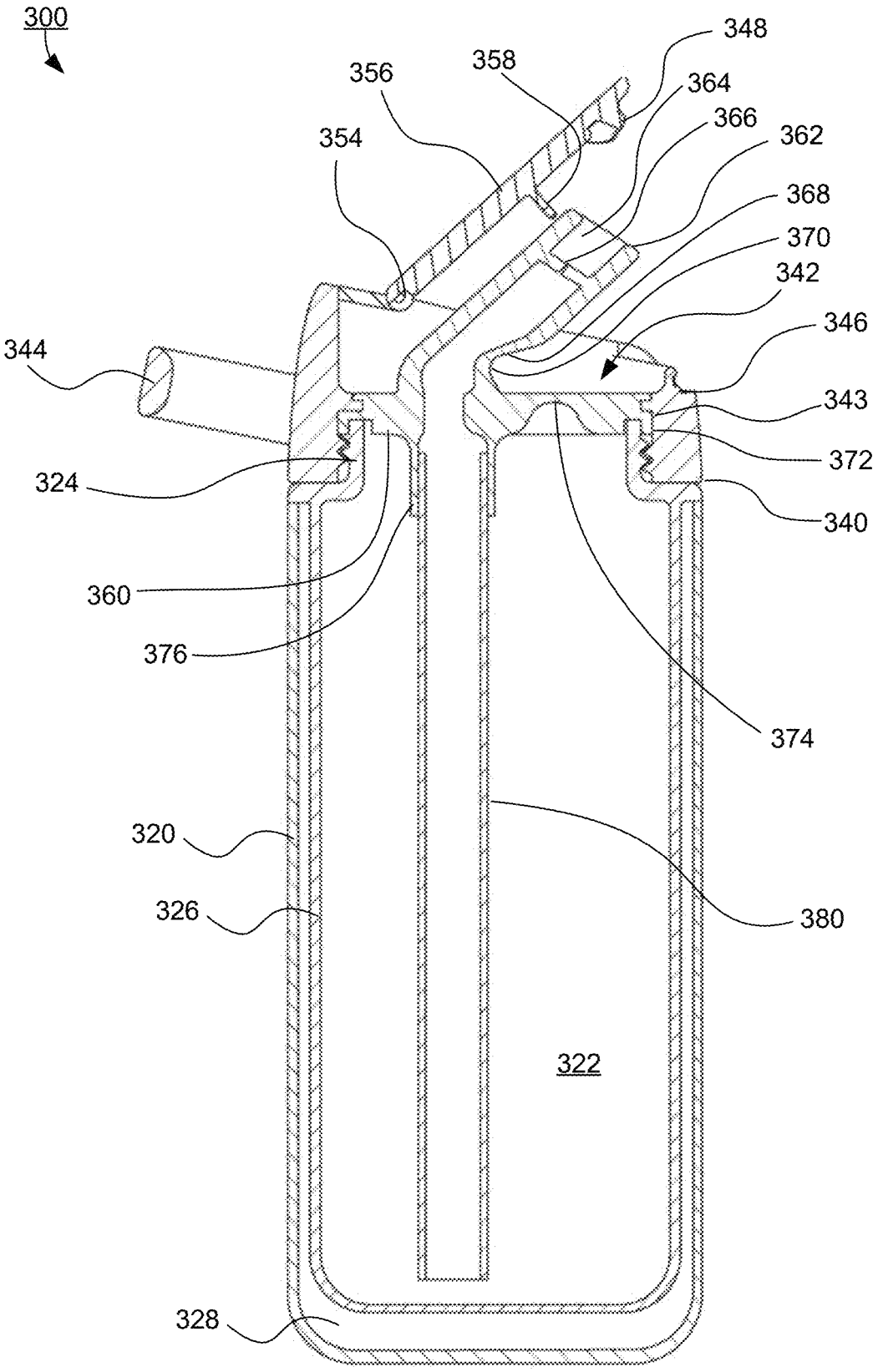
FIG. 24 is a cross-sectional diagram of a bottle closing from an open configuration to a closed configuration, in accordance with some aspects of the present disclosure.

FIG. 24 is a cross-sectional diagram of a bottle closing from an open configuration to a closed configuration, in accordance with some aspects of the present disclosure. As shown, flap 356 is pressed toward the closed position from the open position by pivoting about hinge 354. As flap 356 closes, flap 356 also presses against spout 362 and causes spout 362 to bend at flexing portion 368 into opening 342.

Figure 25:
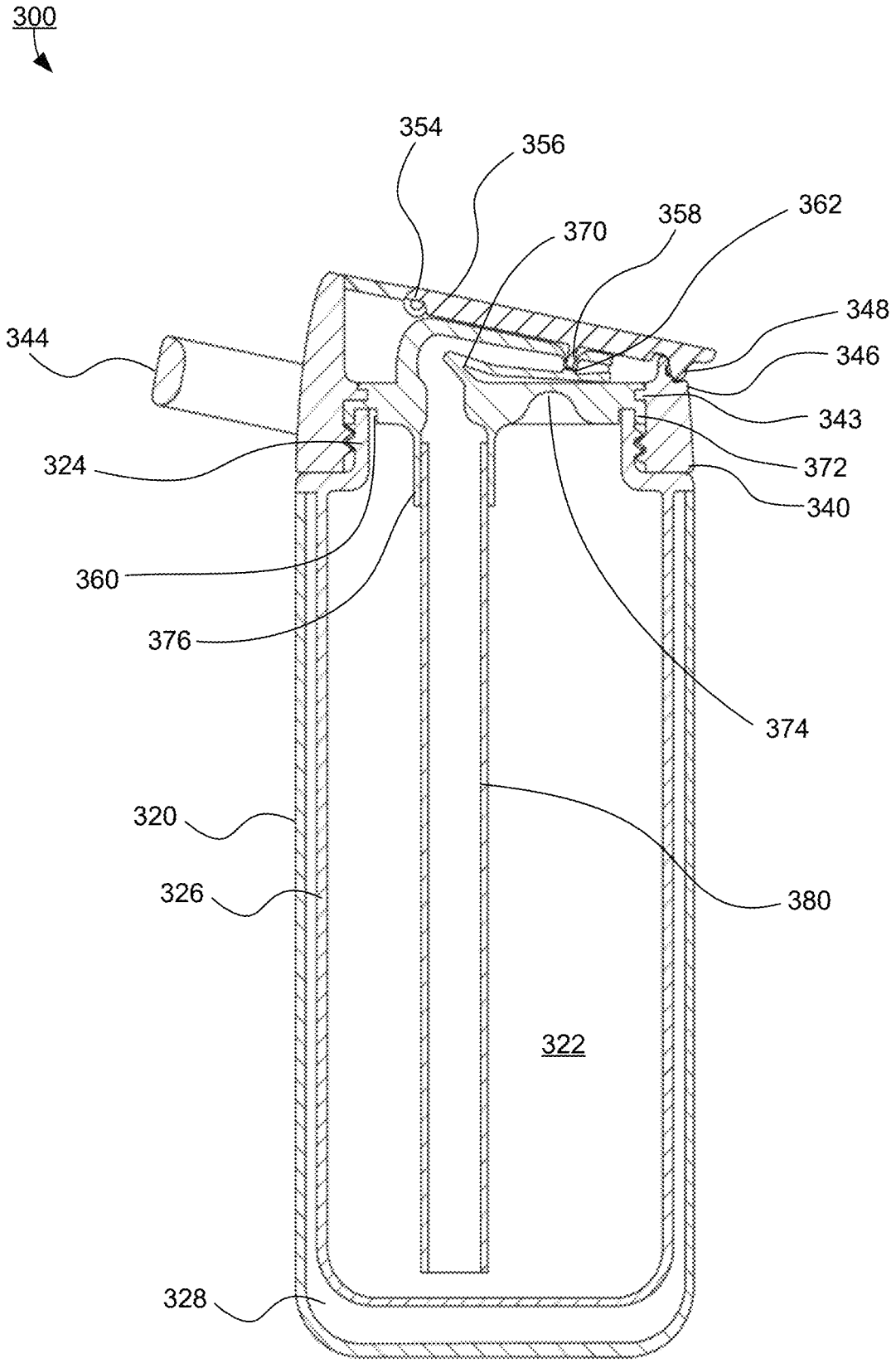
FIG. 25 is a cross-sectional diagram of a bottle in a closed configuration, in accordance with some aspects of the present disclosure.

FIG. 25 is a cross-sectional diagram of a bottle in a closed configuration, in accordance with some aspects of the present disclosure. When in the closed configuration, flap 356 is pressed against lid 340. Additionally, locking protrusion 348 is received and secured in locking recess 346, thereby preventing flap 356 from inadvertently opening. When flap 356 is in the closed position, closing protrusion 358 presses down onto spout 362. As shown, spout 362 is bent at flexing portion 368 and disposed in opening 342 when flap 356 is in the closed position. In some embodiments, spout valve 366 may be positioned in spout 362 such that closing protrusion 358 presses against and closes spout valve 366.

Figure 26:
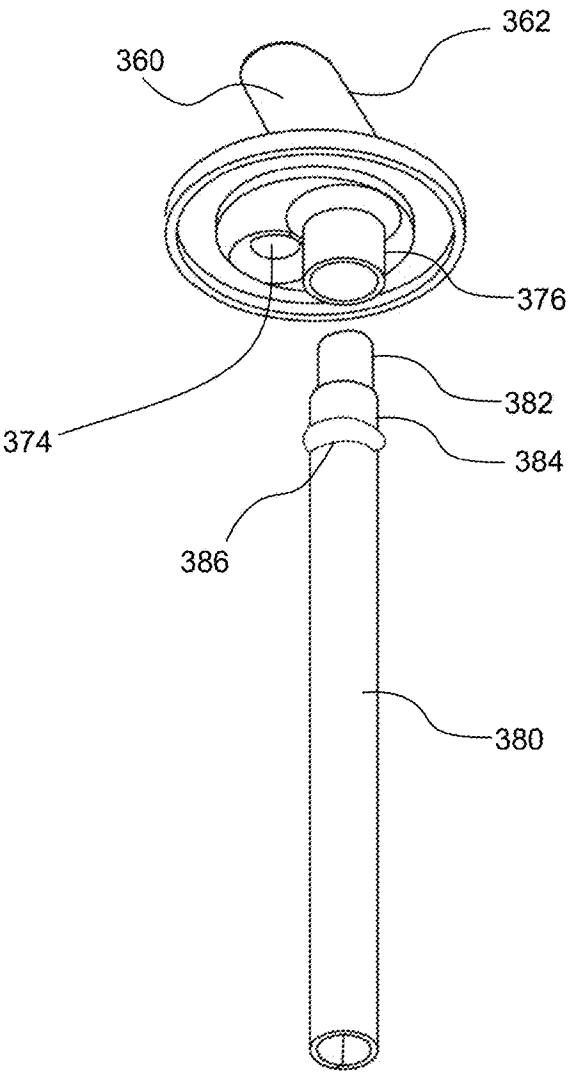
FIG. 26 illustrates an example removable valve and an example straw, in accordance with some aspects of the present disclosure.

FIG. 26 illustrates an example removable valve 360 and an example straw 380, in accordance with some aspects of the present disclosure. Removable valve 360 can also include a straw port 374 disposed on a lower and/or inner surface of removable valve 360. Straw port 374 is configured to receive and secure straw 380. Straw 380 can include an upper portion 382 configured to enter straw port 374. Straw 380 can also include a thickened portion 384 to further secure straw 380 in straw port 374 (e.g., via a friction fit). Straw 380 can also include a stopping protrusion 386 that extends annularly around straw 380 to prevent damage to straw port 374 from excessive insertion of straw 380 into straw port 374.

Figure 27:
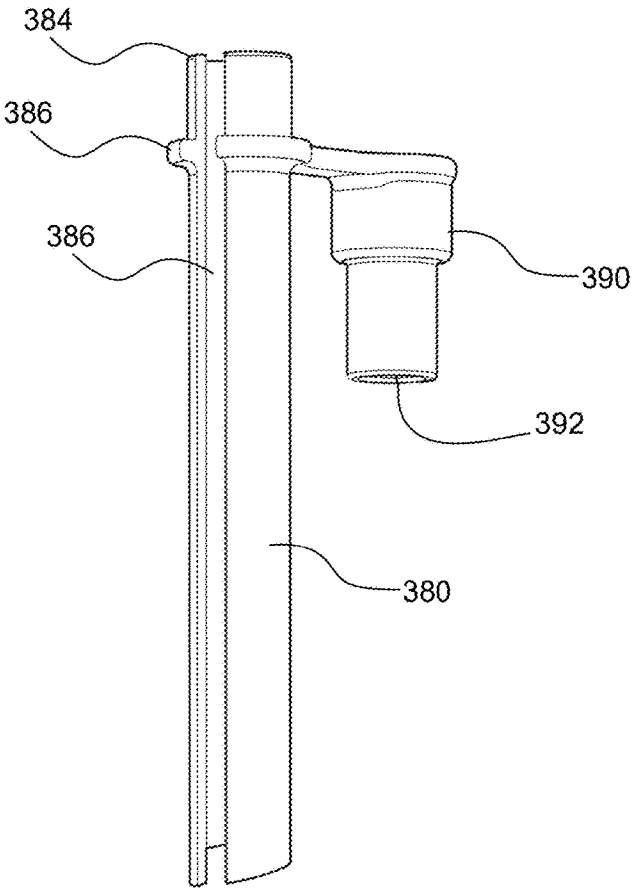
FIG. 27 illustrates an example straw, in accordance with some aspects of the present disclosure.

FIG. 27 illustrates an example straw 380, in accordance with some aspects of the present disclosure. Straw 380 can also include a slit 386 extending along a length of straw 380. Slit 386 is operable to allow access along the length of straw 380 for cleaning. Straw 380 may also have a valve port 390 having a valve port aperture 390 positioned adjacent to pressure valve 374 to allow air therethrough.

The illustrations and examples provided herein are for explanatory purposes and are not intended to limit the scope of the appended claims. It will be recognized by those skilled in the art that changes, or modifications may be made to the above-described embodiments without departing from the broad inventive concepts of the invention. It is understood therefore that the invention is not limited to the particular embodiments which are described but is intended to cover all modifications and changes within the scope and spirit of the subject disclosure.

The foregoing disclosure of the exemplary embodiments of the present subject disclosure has been presented for purposes of illustration and description. It is not intended to be exhaustive or to limit the subject disclosure to the precise forms disclosed. Many variations and modifications of the embodiments described herein will be apparent to one of ordinary skill in the art in light of the above disclosure. The scope of the subject disclosure is to be defined only by the claims appended hereto, and by their equivalents.

Further, in describing representative embodiments of the present subject disclosure, the specification may have presented methods and/or processes of the present subject disclosure as a particular sequence of steps. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the specification should not be construed as limitations on the claims. In addition, the claims directed to the method and/or process of the present subject disclosure should not be limited to the performance of their steps in the order written, and one skilled in the art can readily appreciate that the sequences may be varied and still remain within the spirit and scope of the present subject disclosure.

What is claimed:

1. A removable valve and lid assembly comprising:

a removable valve having a pressure valve and a spout, wherein the spout includes a spout valve disposed therein; and a lid having a closing structure operable to control access to an opening of the lid and a securing mechanism disposed adjacent to the opening, wherein the securing mechanism is configured to receive and secure the removable valve, and wherein the closing structure includes a protrusion configured to press against the spout of the removable valve when the removable valve is disposed within the opening of the lid and when the closing structure is pressed against the spout.

2. The removable valve and lid assembly of claim 1, wherein the lid is configured to cover a container, and wherein the removable valve is operable to control fluid flow from a cavity of the container through the opening when the removable valve is disposed in the lid.

3. The removable valve and lid assembly of claim 1, wherein the lid includes an open position and a closed position.

4. The removable valve and lid assembly of claim 3, wherein the closing structure is positioned away from the spout when the lid is in the open position.

5. The removable valve and lid assembly of claim 3, wherein the projection of the closing structure presses against the spout when the lid is in the closed position.

6. The removable valve and lid assembly of claim 3, wherein the lid includes a hinge operable to pivot the closing structure between the open position and the closed position.

7. The removable valve and lid assembly of claim 1, wherein the lid includes a locking recess operable to receive a locking protrusion disposed on the closing structure to secure the closing structure to the lid.

8. The removable valve and lid assembly of claim 1, wherein the protrusion is positioned on the closing structure to press against the spout valve when the closing structure is pressed against the spout.

9. The removable valve and lid assembly of claim 8, wherein when the protrusion presses against the spout valve, fluid flow through spout valve is prevented.

10. The removable valve and lid assembly of claim 1, wherein the securing mechanism includes an annular projection extending into the opening, and wherein the annular projection is operable to be received and secured by an annular recess extending around a periphery of the removable valve.

* * * * *